US007808519B2

(12) United States Patent
Nomura et al.

(10) Patent No.: US 7,808,519 B2
(45) Date of Patent: Oct. 5, 2010

(54) LINE HEAD AND AN IMAGE FORMING APPARATUS USING THE LINE HEAD

(75) Inventors: Yujiro Nomura, Shiojiri (JP); Nozomu Inoue, Matsumoto (JP); Ryuta Koizumi, Shiojiri (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 469 days.

(21) Appl. No.: 11/777,172

(22) Filed: Jul. 12, 2007

(65) Prior Publication Data

US 2008/0024587 A1 Jan. 31, 2008

(30) Foreign Application Priority Data

Jul. 27, 2006 (JP) ..... 2006-204522
Dec. 13, 2006 (JP) ..... 2006-335486
Dec. 28, 2006 (JP) ..... 2006-355991

(51) Int. Cl.
*B41J 2/435* (2006.01)
*B41J 2/47* (2006.01)

(52) U.S. Cl. ..... 347/234; 347/229; 347/248

(58) Field of Classification Search ..... 347/130, 347/229, 234, 237, 238, 244, 248–250, 258, 347/235

See application file for complete search history.

(56) References Cited

U.S. PATENT DOCUMENTS 4,435,064 A * 3/1984 Tsukada et al. ..... 355/1
5,600,363 A * 2/1997 Anzaki et al. ..... 347/237
6,043,843 A * 3/2000 Kelley et al. ..... 348/335
6,525,752 B2 * 2/2003 Vackier et al. ..... 347/130
7,248,277 B2 * 7/2007 Ishikawa ..... 347/238

FOREIGN PATENT DOCUMENTS

JP 2000-158705 6/2000

* cited by examiner

*Primary Examiner*—Hai C Pham
(74) *Attorney, Agent, or Firm*—Hogan Lovells US LLP

(57) ABSTRACT

A line head, includes: a microlens array in which a plurality of microlenses having a magnification whose absolute value is below 1 are arranged in a main scanning direction of a surface-to-be-scanned, and a plurality of luminous element groups which are arranged in a one-to-one correspondence with the respective plurality of microlenses, wherein in each of the plurality of luminous element groups, a plurality of luminous elements are arranged at mutually different main-scanning-direction positions in the main scanning direction, the plurality of luminous elements are respectively caused to emit lights at timings in conformity with a movement of the surface-to-be-scanned in a sub scanning direction, and light beams emitted from the plurality of luminous elements are imaged on the surface-to-be-scanned at mutually different main-scanning-direction positions in the main scanning direction to form a plurality of spots side by side on the surface-to-be-scanned in the main scanning direction, and in each of the plurality of luminous element groups, out of the plurality of luminous elements constituting the luminous element group, two luminous elements caused to emit lights to form adjacent spots are arranged at mutually different sub-scanning-direction positions in the sub scanning direction.

4 Claims, 14 Drawing Sheets

OPTICAL MAGNIFICATION m>1

OPTICAL MAGNIFICATION m<1

OPTICAL MAGNIFICATION m<1
SP
PHOTOSENSITIVE SURFACE
ML
SUB SCANNING DIRECTION YY
MAIN SCANNING DIRECTION XX
OPTICAL AXIS DIRECTION
WL
2951
ARRANGEMENT OF SPOTS
OPTICAL SYSTEM (MICROLENS ML)
ARRANGEMENT OF LUMINOUS ELEMENTS

TURN-ON OF UPPER LUMINOUS ELEMENT LINE
SP
...
ML
PHOTOSENSITIVE SURFACE
SUB SCANNING DIRECTION YY
MAIN SCANNING DIRECTION XX
WL
2951

TURN-ON OF LOWER LUMINOUS ELEMENT LINE
OPTICAL AXIS DIRECTION
ARRANGEMENT OF SPOTS
OPTICAL SYSTEM (MICROLENS ML)
ARRANGEMENT OF LUMINOUS ELEMENTS

LINE HEAD AND AN IMAGE FORMING APPARATUS USING THE LINE HEAD

CROSS REFERENCE TO RELATED APPLICATION

The disclosure of Japanese Patent Applications enumerated below including specification, drawings and claims is incorporated herein by reference in its entirety:

No. 2006-204522 filed Jul. 27, 2006;

No. 2006-335486 filed Dec. 13, 2006; and

No. 2006-355991 filed Dec. 28, 2006.

BACKGROUND

1, Technical Field

The present invention relates to a line head which scans a light beam across a surface-to-be-scanned and an image forming apparatus using the line head.

2, Related Art

As a line head of this type has been proposed the one using a luminous element array constructed by linearly arraying a plurality of luminous elements at specified intervals in a main scanning direction, as disclosed in JP-A-2000-158705 for example. In such a line head, spots are formed on a surface-to-be-scanned by imaging light beams emitted from a plurality of luminous elements of the luminous element array while enlarging them at a specified magnification by means of an imaging optical system.

SUMMARY

However, in the line head disclosed in JP-A-2000-158705, the luminous elements are linearly (in other words, one-dimensionally) arrayed in the main scanning direction and the spots are formed on the surface-to-be-scanned by the imaging optical system having a magnification whose absolute value is 1 or larger. Thus, upon realizing a high resolution, light quantities of the light beams involved in the spot formation are decreased, which has caused a problem of making it difficult to realize satisfactory spot formation in some cases.

Specifically, for the realization of the high resolution, the size of the spots to be formed on the surface-to-be-scanned needs to be made smaller. However, the imaging optical system having the magnification whose absolute value is larger than 1 (that is, enlarging optical system) is used in the line head disclosed in JP-A-2000-158705. Thus, the size of the luminous elements themselves needs to be made smaller in order to make the spots smaller. As a result, the light quantities of the light beams involved in the spot formation decrease as the size of the luminous elements decreases, which has caused a problem of making it difficult to realize satisfactory spot formation in some cases.

An advantage of some aspects of the invention is to provide a technique capable of realizing satisfactory spot formation by ensuring sufficient light quantities of light beams involved in spot formation even at a high resolution in a line head and an image forming apparatus using a plurality of luminous elements.

According to a first aspect of the invention, there is provided a line head, comprising: a microlens array in which a plurality of microlenses having a magnification whose absolute value is below 1 are arranged in a main scanning direction of a surface-to-be-scanned, and a plurality of luminous element groups which are arranged in a one-to-one correspondence with the respective plurality of microlenses, wherein in each of the plurality of luminous element groups, a plurality of luminous elements are arranged at mutually different main-scanning-direction positions in the main scanning direction, the plurality of luminous elements are respectively caused to emit lights at timings in conformity with a movement of the surface-to-be-scanned in a sub scanning direction, and light beams emitted from the plurality of luminous elements are imaged on the surface-to-be-scanned at mutually different main-scanning-direction positions in the main scanning direction to form a plurality of spots side by side on the surface-to-be-scanned in the main scanning direction, and in each of the plurality of luminous element groups, out of the plurality of luminous elements constituting the luminous element group, two luminous elements caused to emit lights to form adjacent spots are arranged at mutually different sub-scanning-direction positions in the sub scanning direction.

According to a second aspect of the invention, there is provided a line head, comprising: a microlens array in which a plurality of microlenses having a magnification whose absolute value is below 1 are arranged in a main scanning direction of a surface-to-be-scanned, a plurality of luminous element groups which are arranged in a one-to-one correspondence with the respective plurality of microlenses, wherein each of the plurality of luminous element groups includes a plurality of luminous elements which are arranged in a staggered arrangement, the arranged positions of the luminous elements constituting each luminous element group in the main scanning direction differ from each other, and the plurality of luminous elements are respectively caused to emit lights at timings in conformity with a movement of the surface-to-be-scanned in a sub scanning direction, and light beams emitted from the plurality of luminous elements are imaged on the surface-to-be-scanned at mutually different main-scanning-direction positions in the main scanning direction to form a plurality of spots side by side on the surface-to-be-scanned in the main scanning direction.

According to a third aspect of the present invention, there is provided an image forming apparatus, comprising: a latent image carrier whose surface is transported in a sub scanning direction, a line head which images a plurality of spots on the surface of the latent image carrier in a main scanning direction substantially orthogonal to the sub scanning direction to form a latent image, and a developing section which develops the latent image on the latent image carrier with toner, wherein the line head includes: a microlens array in which a plurality of microlenses having a magnification whose absolute value is below 1 are arranged in the main scanning direction, and a plurality of luminous element groups which are arranged in a one-to-one correspondence with the respective plurality of microlenses, wherein in each of the plurality of luminous element groups, a plurality of luminous elements are arranged at mutually different main-scanning-direction positions in the main scanning direction, the plurality of luminous elements are respectively caused to emit lights at timings in conformity with a transportation of the surface of the latent image carrier in the sub scanning direction, and light beams emitted from the plurality of luminous elements are imaged on the surface of the latent image carrier at mutually different main-scanning-direction positions in the main scanning direction to form a plurality of spots side by side on the surface of the latent image carrier in the main scanning direction, and in each of the plurality of luminous element groups, out of the plurality of luminous elements constituting the luminous element group, two luminous elements caused to emit lights to form adjacent spots are arranged at mutually different sub-scanning-direction positions in the sub scanning direction.

According to a fourth aspect of the present invention, there is provided an image forming apparatus, comprising: a latent image carrier whose surface is transported in a sub scanning direction, a line head which images a plurality of spots on the surface of the latent image carrier in a main scanning direction substantially orthogonal to the sub scanning direction to form a latent image, and a developing section which develops the latent image on the latent image carrier with toner, wherein the line head includes: a microlens array in which a plurality of microlenses having a magnification whose absolute value is below 1 are arranged in the main scanning direction, and a plurality of luminous element groups which are arranged in a one-to-one correspondence with the respective plurality of microlenses, wherein each of the plurality of luminous element groups has a plurality of luminous elements arranged in a staggered arrangement, the arranged positions of the luminous elements constituting each luminous element group in the main scanning direction differ from each other, and the plurality of luminous elements are respectively caused to emit lights at timings in conformity with a transportation of the surface of the latent image carrier in the sub scanning direction, and light beams emitted from the plurality of luminous elements are imaged on the surface of the latent image carrier at mutually different main-scanning-direction positions in the main scanning direction to form a plurality of spots side by side on the surface of the latent image carrier in the main scanning direction.

In the inventions (a line head and an image forming apparatus using the line head), the light beams emitted from the luminous elements are imaged on the surface-to-be-scanned (surface of a latent image carrier) by the microlenses having the magnification whose absolute value is below 1 (that is, reducing optical systems). Thus, light beams emitted from large luminous elements can be imaged into small spots. In other words, small spots can be formed by light beams having large light quantities. In the invention, the microlenses and the luminous element groups are arranged as described above while using such microlenses. Thus, high resolution can be realized while sufficient light quantities of the light beams involved in the spot formation are ensured, and it is possible to realize good formation of spots even in high resolution. The reason is as follows.

In order to improve the resolution in an apparatus using an enlarging optical system as disclosed in JP-A-2000-158705 for example, the diameter of luminous elements needs to be made smaller. However, it is difficult in production to make the diameter of the element smaller while ensuring emission of light with a desired light quantity. Further, the driving of the luminous elements becomes unstable and spots cannot be satisfactorily formed on a surface-to-be-scanned (surface of a latent image carrier). Particularly, this has been a main cause of image quality deterioration in image forming apparatuses.

On the other hand, the diameter of the luminous elements can be set larger since the microlenses, which are reducing optical systems, are used in the invention. In addition, the luminous elements are arranged in the luminous element groups as described above. In other words, in each luminous element group, the luminous elements are arranged at mutually different main-scanning-direction positions in the main scanning direction, and two luminous elements caused to emit lights to form spots adjacent to each other are arranged at mutually different sub-scanning-direction positions in the sub scanning direction. Accordingly, intervals between the luminous elements can be widened even if intervals between spots to be formed on the surface-to-be-scanned (surface of the latent image carrier) are small. Thus, the luminous elements having a diameter sufficiently large to provide emission of light with desired light quantities can be formed in a relatively large space because (a) the reducing optical systems are used and (b) the arrangement of the luminous elements in the luminous element groups is contrived. Therefore, the elements can be easily formed. Further, the driving of the luminous elements can be stabilized, which enables good spots to be formed on the surface-to-be-scanned (surface of the latent image carrier). By applying this to an image forming apparatus, a toner image of an excellent quality can be formed.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DESCRIPTION OF EXEMPLARY EMBODIMENTS

Figure 1:
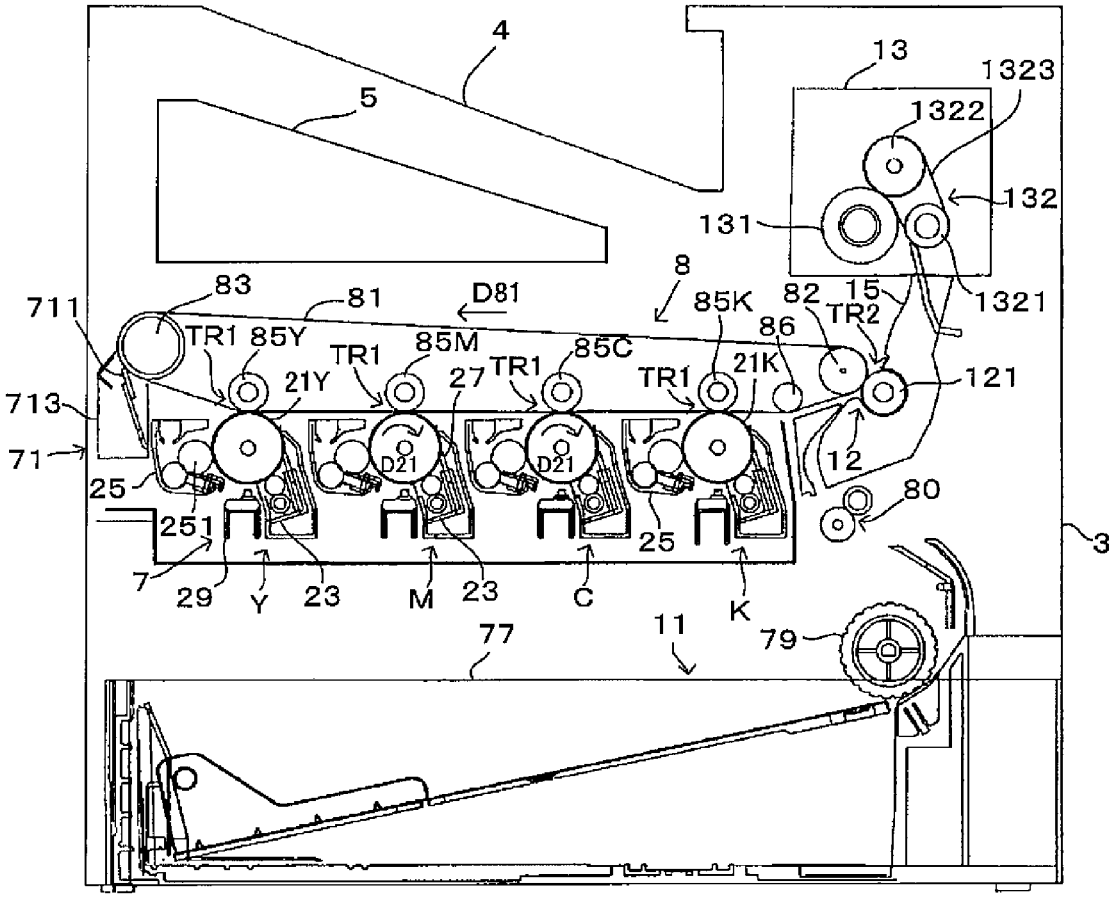
FIG. 1 is a diagram showing an embodiment of an image forming apparatus according to the invention.
Figure 2:
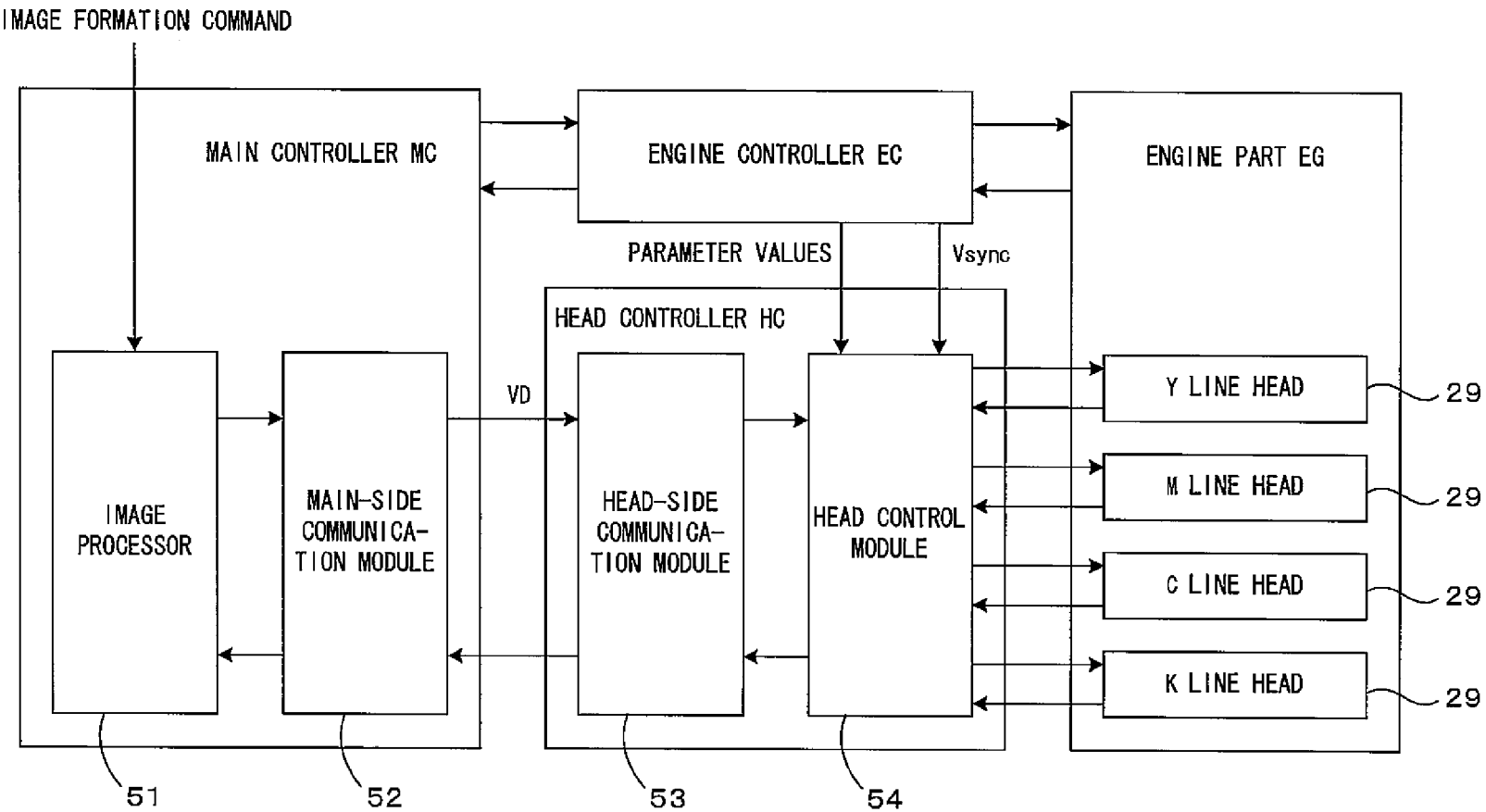
FIG. 2 is a diagram showing the electrical construction of the image forming apparatus of FIG. 1.

FIG. 1 is a diagram showing an embodiment of an image forming apparatus according to the invention, and FIG. 2 is a diagram showing the electrical construction of the image forming apparatus of FIG. 1. This apparatus is an image forming apparatus that can selectively execute a color mode for forming a color image by superimposing four color toners of black (K), cyan (C), magenta (M) and yellow (Y) and a monochromatic mode for forming a monochromatic image using only black (K) toner. FIG. 1 is a diagram corresponding to the execution of the color mode. In this image forming apparatus, when an image formation command is given from an external apparatus such as a host computer to a main controller MC having a CPU and memories, the main controller MC feeds a control signal and the like to an engine controller EC and feeds video data VD corresponding to the image formation command to a head controller HC. This head controller HC controls line heads 29 of the respective colors based on the video data VD from the main controller MC, a vertical synchronization signal Vsync from the engine controller EC and parameter values from the engine controller EC. In this way, an engine part EG performs a specified image forming operation to form an image corresponding to the image formation command on a sheet such as a copy sheet, transfer sheet, form sheet or transparent sheet for OHP.

An electrical component box 5 having a power supply circuit board, the main controller MC, the engine controller EC and the head controller HC built therein is disposed in a housing main body 3 of the image forming apparatus according to this embodiment. An image forming unit 7, a transfer belt unit 8 and a sheet feeding unit 11 are also arranged in the housing main body 3. A secondary transfer unit 12, a fixing unit 13, and a sheet guiding member 15 are arranged at the right side in the housing main body 3 in FIG. 1. It should be noted that the sheet feeding unit 11 is detachably mountable into the housing main body 3. The sheet feeding unit 11 and the transfer belt unit 8 are so constructed as to be detachable for repair or exchange respectively.

The image forming unit 7 includes four image forming stations Y (for yellow), M (for magenta), C (for cyan) and K (for black) which form a plurality of images having different colors. Each of the image forming stations Y, M, C and K includes a photosensitive drum 21 on the surface of which a toner image of the corresponding color is to be formed. Each photosensitive drum 21 is connected to its own driving motor and is driven to rotate at a specified speed in a direction of arrow D21 in FIG. 1, whereby the surface of the photosensitive drum 21 is transported in a sub scanning direction. Further, a charger 23, the line head 29, a developer 25 and a photosensitive drum cleaner 27 are arranged in a rotating direction around each photosensitive drum 21. A charging operation, a latent image forming operation and a toner developing operation are performed by these functional sections. Accordingly, a color image is formed by superimposing toner images formed by all the image forming stations Y, M, C and K on a transfer belt 81 of the transfer belt unit 8 at the time of executing the color mode, and a monochromatic image is formed using only a toner image formed by the image forming station K at the time of executing the monochromatic mode. Meanwhile, since the respective image forming stations of the image forming unit 7 are identically constructed, reference characters are given to only some of the image forming stations while being not given to the other image forming stations in order to facilitate the diagrammatic representation in FIG. 1.

The charger 23 includes a charging roller having the surface thereof made of an elastic rubber. This charging roller is constructed to be rotated by being held in contact with the surface of the photosensitive drum 21 at a charging position. As the photosensitive drum 21 rotates, the charging roller is rotated at the same circumferential speed in a direction driven by the photosensitive drum 21. This charging roller is connected to a charging bias generator (not shown) and charges the surface of the photosensitive drum 21 at the charging position where the charger 23 and the photosensitive drum 21 are in contact upon receiving the supply of a charging bias from the charging bias generator.

Each line head 29 includes a plurality of luminous elements arrayed in the axial direction of the photosensitive drum 21 (direction normal to the plane of FIG. 1) and is positioned separated from the photosensitive drum 21. Lights are emitted from these luminous elements to the surface of the photosensitive drum 21 charged by the charger 23, thereby forming a latent image on this surface. In this embodiment, the head controller HC is provided to control the line heads 29 of the respective colors, and controls the respective line heads 29 based on the video data VD from the main controller MC and a signal from the engine controller EC. Specifically, in this embodiment, image data included in an image formation command is inputted to an image processor 51 of the main controller MC. Then, video data VD of the respective colors are generated by applying various image processings to the image data, and the video data VD are fed to the head controller HC via a main-side communication module 52. In the head controller HC, the video data VD are fed to a head control module 54 via a head-side communication module 53. Signals representing parameter values relating to the formation of a latent image and the vertical synchronization signal Vsync are fed to this head control module 54 from the engine controller EC as described above. The head controller HC generates signals for controlling the driving of the elements of the line heads 29 of the respective colors and outputs them to the respective line heads 29. In this way, the operations of the luminous elements in the respective line heads 29 are suitably controlled to form latent images corresponding to the image formation command.

In this embodiment, the photosensitive drum 21, the charger 23, the developer 25 and the photosensitive drum cleaner 27 of each of the image forming stations Y, M, C and K are unitized as a photosensitive cartridge. Further, each photosensitive cartridge includes a nonvolatile memory for storing information on the photosensitive cartridge. Wireless communication is performed between the engine controller EC and the respective photosensitive cartridges. By doing so, the information on the respective photosensitive cartridges is transmitted to the engine controller EC and information in the respective memories can be updated and stored.

The developer 25 includes a developing roller 251 carrying toner on the surface thereof. By a development bias applied to the developing roller 251 from a development bias generator (not shown) electrically connected to the developing roller 251, charged toner is transferred from the developing roller 251 to the photosensitive drum 21 to develop the latent image formed by the line head 29 at a development position where the developing roller 251 and the photosensitive drum 21 are in contact.

The toner image developed at the development position in this way is primarily transferred to the transfer belt 81 at a primary transfer position TR1 to be described later where the transfer belt 81 and each photosensitive drum 21 are in contact after being transported in the rotating direction D21 of the photosensitive drum 21.

Further, in this embodiment, the photosensitive drum cleaner 27 is disposed in contact with the surface of the photosensitive drum 21 downstream of the primary transfer position TR1 and upstream of the charger 23 with respect to the rotating direction D21 of the photosensitive drum 21. This photosensitive drum cleaner 27 removes the toner remaining on the surface of the photosensitive drum 21 to clean after the primary transfer by being held in contact with the surface of the photosensitive drum.

The transfer belt unit 8 includes a driving roller 82, a driven roller (blade facing roller) 83 arranged to the left of the driving roller 82 in FIG. 1, and the transfer belt 81 mounted on these rollers and driven to turn in a direction of an arrow D81 in FIG. 1 (transporting direction). The transfer belt unit 8 also includes four primary transfer rollers 85Y, 85M, 85C and 85K arranged to face in a one-to-one relationship with the photosensitive drums 21 of the respective image forming stations Y, M, C and K inside the transfer belt 81 when the photosensitive cartridges are mounted. These primary transfer rollers 85Y, 85M, 85C and 85K are respectively electrically connected to a primary transfer bias generator (not shown). As described in detail later, at the time of executing the color mode, all the primary transfer rollers 85Y, 85M, 85C and 85K are positioned on the sides of the image forming stations Y, M, C and K as shown in FIG. 1, whereby the transfer belt 81 is pressed into contact with the photosensitive drums 21 of the image forming stations Y, M, C and K to form the primary transfer positions TR1 between the respective photosensitive drums 21 and the transfer belt 81. By applying primary transfer biases from the primary transfer bias generator to the primary transfer rollers 85Y, 85M, 85C and 85K at suitable timings, the toner images formed on the surfaces of the respective photosensitive drums 21 are transferred to the surface of the transfer belt 81 at the corresponding primary transfer positions TR1 to form a color image.

On the other hand, out of the four primary transfer rollers 85Y, 85M, 85C and 85K, the color primary transfer rollers 85Y, 85M, 85C are separated from the facing image forming stations Y, M and C and only the monochromatic primary transfer roller 85K is brought into contact with the image forming station K at the time of executing the monochromatic mode, whereby only the monochromatic image forming station K is brought into contact with the transfer belt 81. As a result, the primary transfer position TR1 is formed only between the monochromatic primary transfer roller 85K and the image forming station K. By applying a primary transfer bias at a suitable timing from the primary transfer bias generator to the monochromatic primary transfer roller 85K, the toner image formed on the surface of the photosensitive drum 21 is transferred to the surface of the transfer belt 81 at the primary transfer position TR1 to form a monochromatic image.

The transfer belt unit 8 further includes a downstream guide roller 86 disposed downstream of the monochromatic primary transfer roller 85K and upstream of the driving roller 82. This downstream guide roller 86 is so disposed as to come into contact with the transfer belt 81 on an internal common tangent to the primary transfer roller 85K and the photosensitive drum 21 at the primary transfer position TRI formed by the contact of the monochromatic primary transfer roller 85K with the photosensitive drum 21 of the image forming station K.

The driving roller 82 drives to rotate the transfer belt 81 in the direction of the arrow D81 and doubles as a backup roller for a secondary transfer roller 121 A rubber layer having a thickness of about 3 mm and a volume resistivity of 1000 kΩ·cm or lower is formed on the circumferential surface of the driving roller 82 and is grounded via a metal shaft, thereby serving as an electrical conductive path for a secondary transfer bias to be supplied from an unillustrated secondary transfer bias generator via the secondary transfer roller 121. By providing the driving roller 82 with the rubber layer having high friction and shock absorption, an impact caused upon the entrance of a sheet into a contact part (secondary transfer position TR2) of the driving roller 82 and the secondary transfer roller 121 is unlikely to be transmitted to the transfer belt 81 and image deterioration can be prevented.

The sheet feeding unit 11 includes a sheet feeding section which has a sheet cassette 77 capable of holding a stack of sheets, and a pickup roller 79 which feeds the sheets one by one from the sheet cassette 77. The sheet fed from the sheet feeding section by the pickup roller 79 is fed to the secondary transfer position TR2 along the sheet guiding member 15 after having a sheet feed timing adjusted by a pair of registration rollers 80.

The secondary transfer roller 121 is provided freely to abut on and move away from the transfer belt 81, and is driven to abut on and move away from the transfer belt 81 by a secondary transfer roller driving mechanism (not shown). The fixing unit 13 includes a heating roller 131 which is freely rotatable and has a heating element such as a halogen heater built therein, and a pressing section 132 which presses this heating roller 131. The sheet having an image secondarily transferred to the front side thereof is guided by the sheet guiding member 15 to a nip portion formed between the heating roller 131 and a pressure belt 1323 of the pressing section 132, and the image is thermally fixed at a specified temperature in this nip portion. The pressing section 132 includes two rollers 1321 and 1322 and the pressure belt 1323 mounted on these rollers. Out of the surface of the pressure belt 1323, a part stretched by the two rollers 1321 and 1322 is pressed against the circumferential surface of the heating roller 131, thereby forming a sufficiently wide nip portion between the heating roller 131 and the pressure belt 1323. The sheet having been subjected to the image fixing operation in this way is transported to the discharge tray 4 provided on the upper surface of the housing main body 3.

Further, a cleaner 71 is disposed facing the blade facing roller 83 in this apparatus. The cleaner 71 includes a cleaner blade 711 and a waste toner box 713. The cleaner blade 711 removes foreign matters such as toner remaining on the transfer belt after the secondary transfer and paper powder by holding the leading end thereof in contact with the blade facing roller 83 via the transfer belt 81. Foreign matters thus removed are collected into the waste toner box 713. Further, the cleaner blade 711 and the waste toner box 713 are constructed integral to the blade facing roller 83. Accordingly, if the blade facing roller 83 moves as described next, the cleaner blade 711 and the waste toner box 713 move together with the blade facing roller 83.

Figure 3:
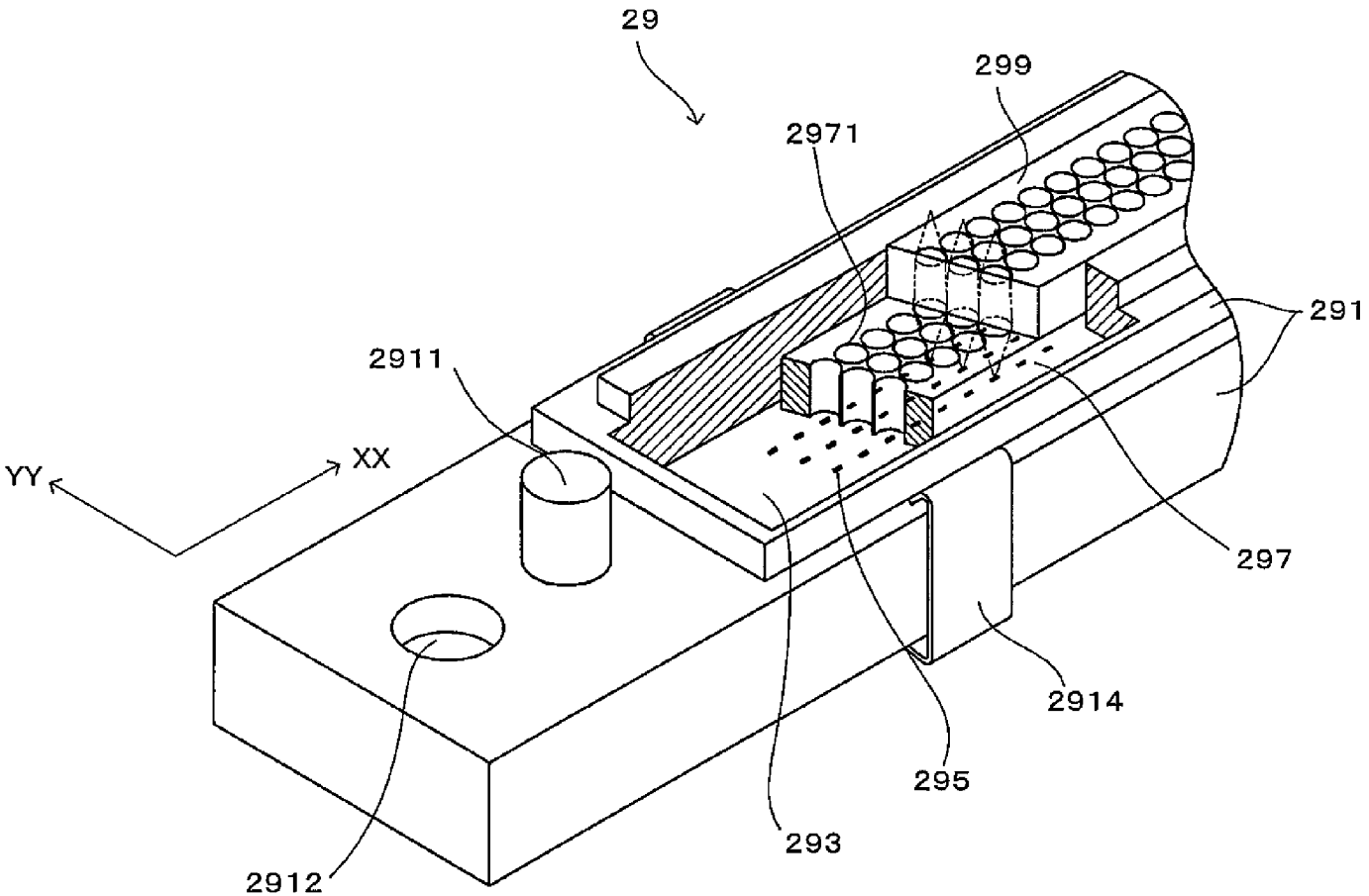
FIG. 3 is a perspective view schematically showing an embodiment of the line head according to the invention.
Figure 4:
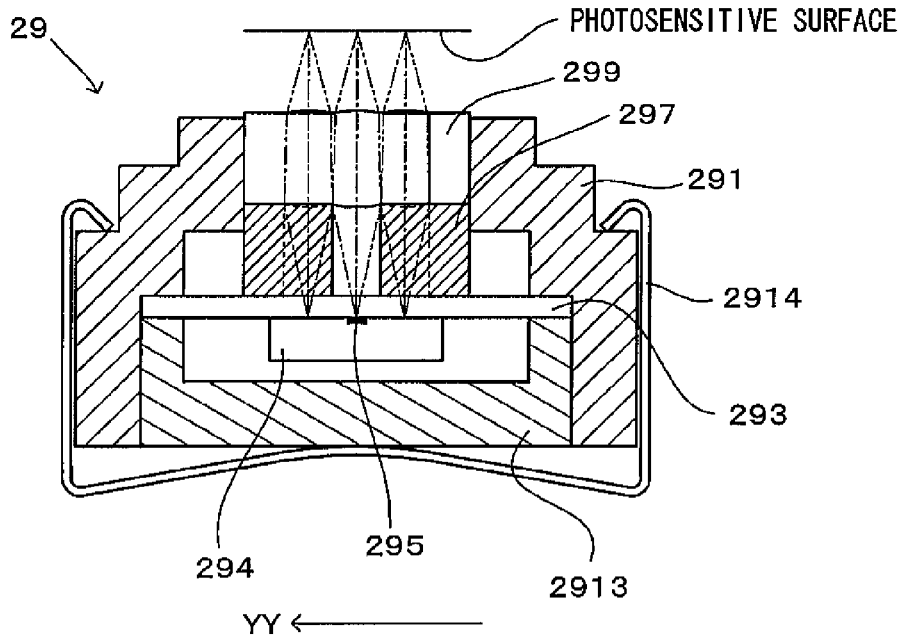
FIG. 4 is a sectional view in the sub scanning direction of the embodiment of the line head according to the invention.

FIG. 3 is a perspective view schematically showing an embodiment of the line head (exposure section) according to the invention, and FIG. 4 is a sectional view in the sub scanning direction of the embodiment of the line head (exposure section) according to the invention. The line head 29 according to this embodiment includes a case 291 of which the longitudinal direction is parallel to a main scanning direction XX. A positioning pin 2911 and a screw insertion hole 2912 are provided at each of the opposite ends of the case 291. The line head 29 is positioned with respect to the photosensitive drum 21 by fitting the positioning pins 2911 into positioning holes (not shown) formed in a photosensitive drum cover (not shown) which covers the photosensitive drum 21 and is positioned with respect to the photosensitive drum 21. Further, the line head 29 is fixed with respect to the photosensitive drum 21 by screwing fixing screws into screw holes (not shown) of the photosensitive drum cover through the screw insertion holes 2912 to fix.

The case 291 carries a microlens array 299 at a position facing the surface of the photosensitive drum 21, and includes, inside thereof, a light shielding member 297 and a glass substrate 293 in this order closer to the microlens array 299. A plurality of luminous element groups 295 are arranged on the underside surface of the glass substrate 293 (surface opposite to the one where the microlens array 299 is disposed out of two surfaces of the glass substrate 293). Specifically, the plurality of luminous element groups 295 are two-dimensionally arranged on the underside surface of the glass substrate 293 while being spaced apart at specified intervals from each other in the main scanning direction XX and in a sub scanning direction YY. Here, each of the plurality of luminous element groups 295 is composed of a plurality of two-dimensionally arranged luminous elements, and is described later. In this embodiment, an organic EL (electroluminescence) device of bottom emission type is used as the luminous element. In other words, the organic EL devices are arranged on the underside surface of the glass substrate 293 as the luminous elements. When the respective luminous elements are driven by driving circuits (denoted at D295 in FIG. 7 to be described later) formed on this glass substrate 293, light beams are emitted from the luminous elements in a direction toward the photosensitive drum 21. These light beams are headed for the light shielding member 297 via the glass substrate 293. It should be noted that the constructions of the luminous element groups 295, the driving circuits and the like mentioned above are described later.

The light shielding member 297 is formed with a plurality of light guiding holes 2971 which are in a one-to-one correspondence with the plurality of luminous element groups 295. Each of the light guiding holes 2971 is in the form of a substantial cylinder whose central axis is parallel to a normal line to the surface of the glass substrate 293, and penetrates the light shielding member 297. Thus, all the lights emitted from the luminous elements belonging to one luminous element group 295 are headed for the microlens array 299 via the same light guiding hole 2971, and the interference of light beams emitted from different luminous element groups 295 is prevented by means of the light shielding member 297. The light beams having passed through the light guiding holes 2971 formed in the light shielding member 297 are imaged as spots on the surface of the photosensitive drum 21 by means of the microlens array 299. It should be noted that the specific construction of the microlens array 299 and the imaged state of the light beams by the microlens array 299 are described in detail later.

As shown in FIG. 4, an underside lid 2913 is pressed to the case 291 via the glass substrate 293 by a retainer 2914. Specifically, the retainer 2914 has an elastic force to press the underside lid 2913 toward the case 291, and seals the inside of the case 291 light-tight (that is, so that light does not leak from the inside of the case 291 and so that light does not intrude into the case 291 from the outside) by pressing the underside lid 2913 by means of the elastic force. It should be noted that a plurality of the retainers 2914 are provided at a plurality of positions in the longitudinal direction of the case 291. The luminous element groups 295 are covered with a sealing member 294.

Figure 5:
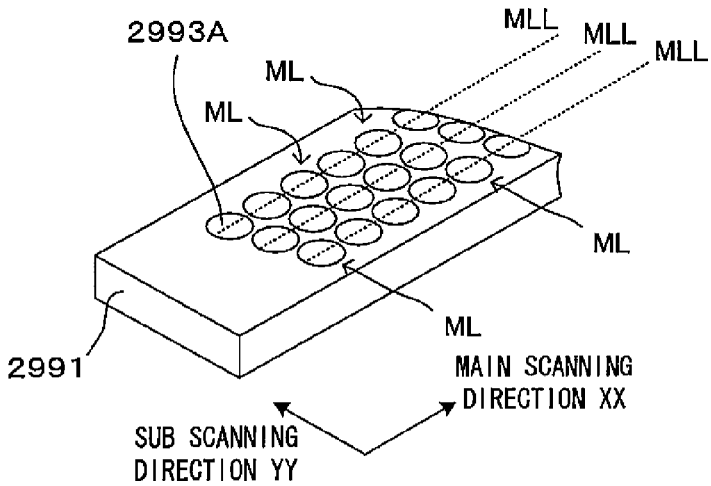
FIG. 5 is a perspective view schematically showing the microlens array.
Figure 6:
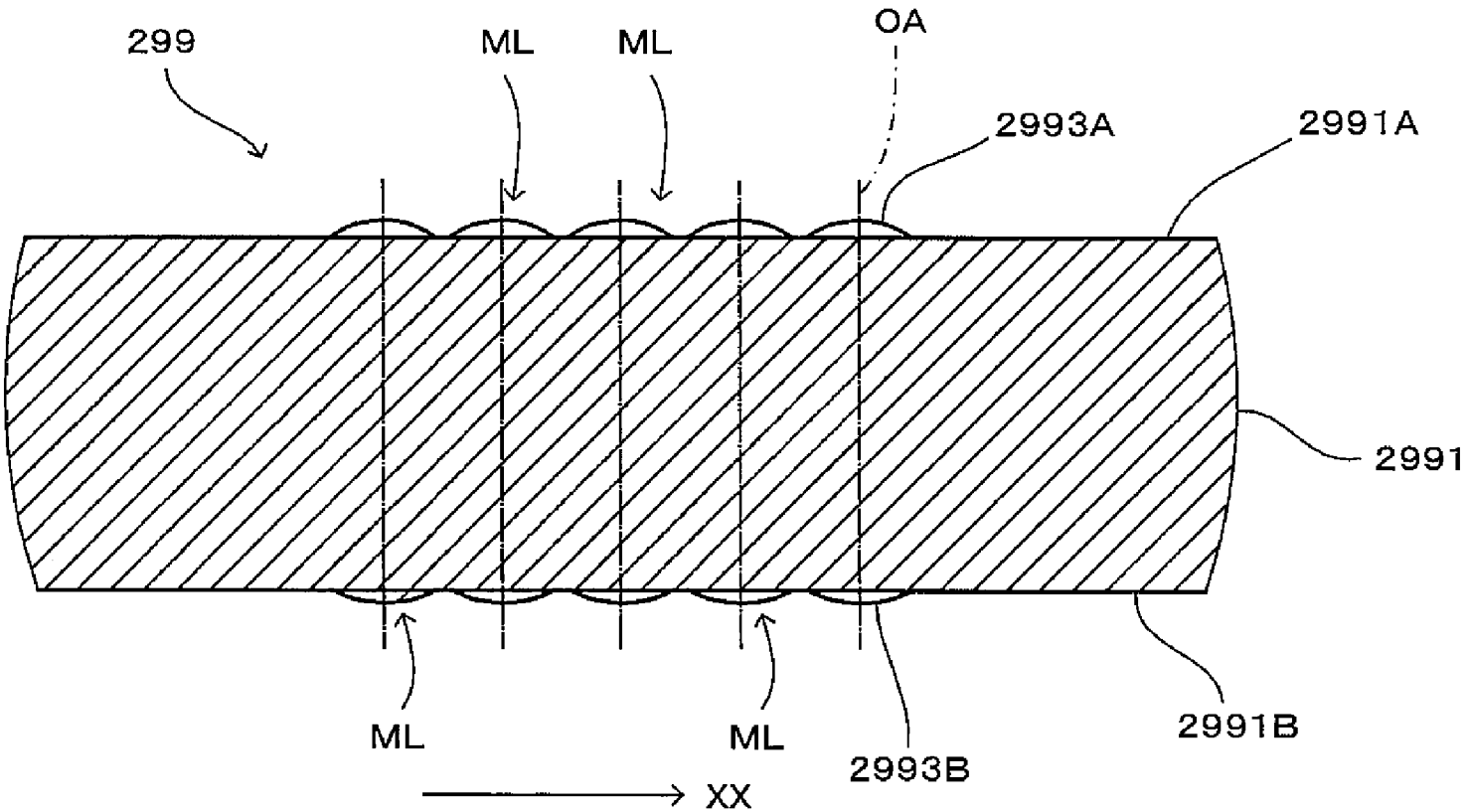
FIG. 6 is a sectional view of the microlens array in the main scanning direction.

FIG. 5 is a perspective view schematically showing the microlens array, and FIG. 6 is a sectional view of the microlens array in the main scanning direction. The microlens array 299 includes a glass substrate 2991 and a plurality of lens pairs each comprised of two lenses 2993A and 2993B which are arranged in a one-to-one correspondence at the opposite sides of the glass substrate 2991. Meanwhile, these lenses 2993A and 2993B can be made of resin.

Specifically, a plurality of lenses 2993A are arranged on a top surface 2991A of the glass substrate 2991, and a plurality of lenses 2993B are so arranged on an underside surface 2991B of the glass substrate 2991 as to correspond one-to-one to the plurality of lenses 2993A. Further, two lenses 2993A and 2993B constituting a lens pair have a common optical axis OA. These plurality of lens pairs are arranged in a one-to-one correspondence with the plurality of luminous element groups 295. Specifically, the plurality of lens pairs are two-dimensionally arranged and spaced apart from each other at specified intervals in the main scanning direction XX and the sub scanning direction YY corresponding to the arrangement of the luminous element groups 295. More specifically, in this microlens array 299, an imaging optical system including the lens pair comprised of the lenses 2993A and 2993B and the glass substrate 2991 located between the lens pair corresponds to a microlens according to the invention. A plurality of (three in this embodiment) lens lines MLL formed by arranging a plurality of microlenses in the main scanning direction XX are arranged in the sub scanning direction YY, thereby arranging a plurality of microlenses ML in a staggered arrangement.

Figure 7:
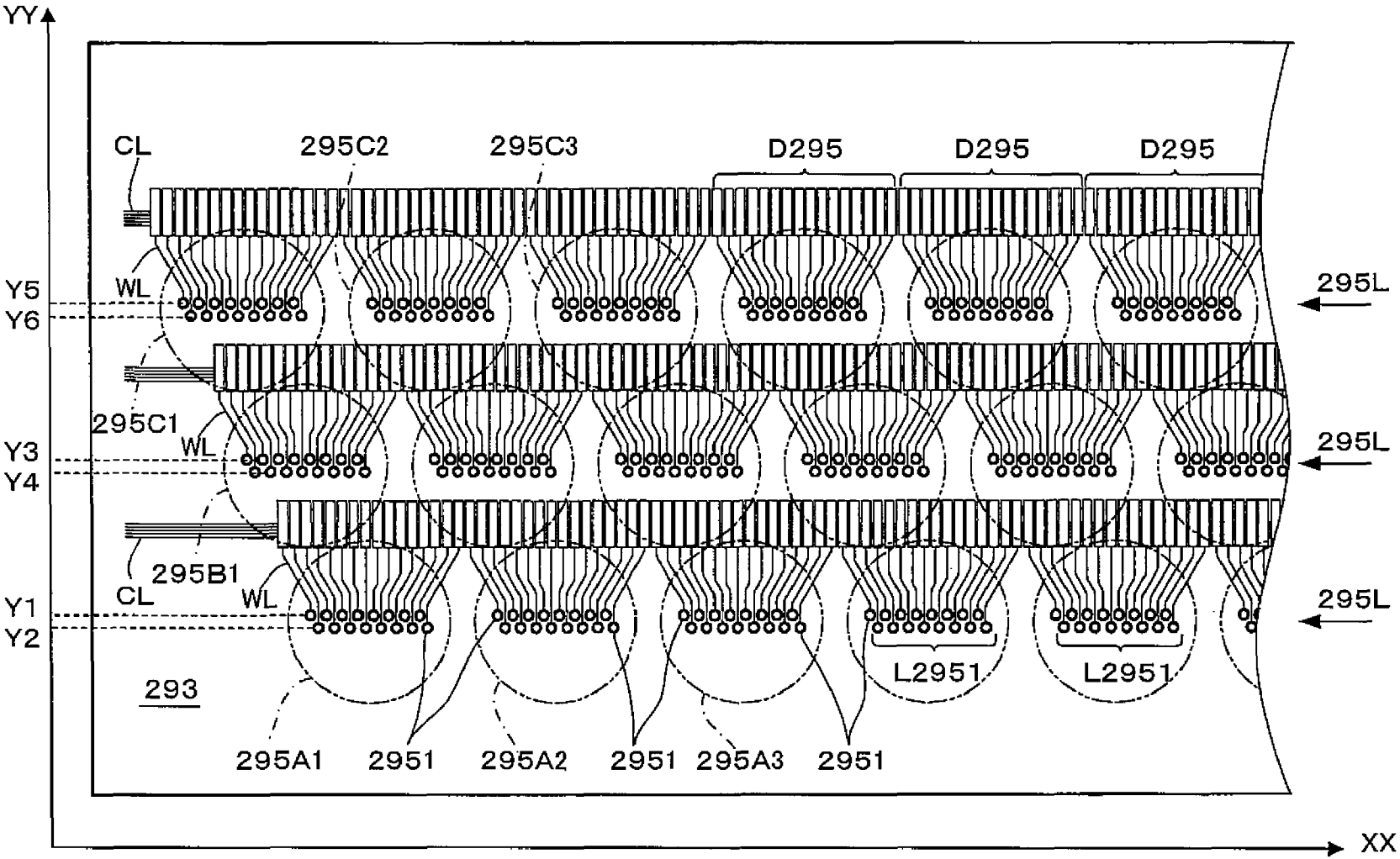
FIG. 7 is a diagram showing the arrangement and wiring of the respective parts in the line head.

FIG. 7 is a diagram showing the arrangement and wiring of the respective parts in the line head. Hereinafter, the arrangement of the luminous element groups, the arrangement of the driving circuits which drives the respective luminous elements, the wiring which electrically connects the driving circuits and the luminous elements, and control signal lines which controls the luminous elements are sequentially described. In this embodiment, one luminous element group 295 is constructed by arranging two luminous element lines L2951, each of which is formed by arranging eight luminous elements 2951 at specified intervals in the main scanning direction XX, in the sub scanning direction YY In other words, a total of sixteen luminous elements 2951 encircled by chain double-dashed line in FIG. 7 constitute one luminous element group 295. And a plurality of luminous element groups 295 are arranged as follows.

Specifically, the luminous element groups 295 are arranged such that three luminous element group lines 295L, each of which is formed by arranging a specified number of luminous element groups in the main scanning direction XX, are arranged in the sub scanning direction YY All the luminous element groups 295 are arranged at mutually different main-scanning-direction positions. Further, the plurality of luminous element groups 295 are arranged such that the luminous element groups having adjacent main-scanning-direction positions (for example, luminous element group 295C1 and luminous element group 295B1) are located at different sub-scanning-direction positions. Here, the luminous element lines L2951 belonging to the two luminous element groups having adjacent main-scanning-direction positions are arranged to partly overlap in the main scanning direction XX for the following reason. Specifically, as described later, a light beam emitted from the luminous element 2951 is imaged on the surface of the photosensitive drum 21 (hereinafter, called "photosensitive surface") by means of a reducing optical system having a magnification below 1 in this embodiment. Thus, in order to continuously form a plurality of spots in the main scanning direction XX on the photosensitive surface, the luminous element lines L2951 are arranged as described above. In this specification, it is assumed that the position of each luminous element 2951 is the geometric gravity center and the position of each luminous element group 295 is the geometric gravity center of the positions of all the luminous elements belonging to the same luminous element group 295. Further, the main-scanning-direction position and the sub-scanning-direction position mean a main-scanning-direction component and a sub-scanning-direction component of a target position respectively.

Further, in this embodiment, a part of the driving circuits D295 including TFTs (thin film transistors) for driving the luminous elements 2951 arranged as described above and a part of wiring WL which electrically connects the driving circuits D295 and the luminous elements 2951 are arranged on the substrate 293 as shown in FIG. 7. For example, in a gap area surrounded by the luminous element groups 295C1, 295C2 and 295B1, the driving circuit (TFT) D295 for driving the luminous element group 295B1 is arranged and the driving circuit D295 and the luminous element group 295B1 are electrically connected by the wiring WL. In an each of other gap areas as well, the driving circuit D295 and the wiring WL are formed similar to the above. Denoted at CL in FIG. 7 are control signal lines which transmits control signals for controlling the luminous elements 2951 to the driving circuits D295.

The light guiding holes 2971 are perforated in the light shielding member 297 and the lens pairs each comprised of the lenses 2993A and 2993B are arranged both corresponding to the arrangement of the above luminous element groups 295. In other words, the gravity center position of the luminous element group 295, the central axis of the light guiding hole 2971 and the optical axis OA of the lens pair which consists of the lenses 2993A and 2993B are structured to substantially coincide in this embodiment. The light beams emitted from the luminous elements 2951 of the luminous element groups 295 are incident on the microlens array 299 via the corresponding light guiding holes 2971 and imaged as spots on the surface of the photosensitive drum 21 by the microlens array 299.

Figure 8:
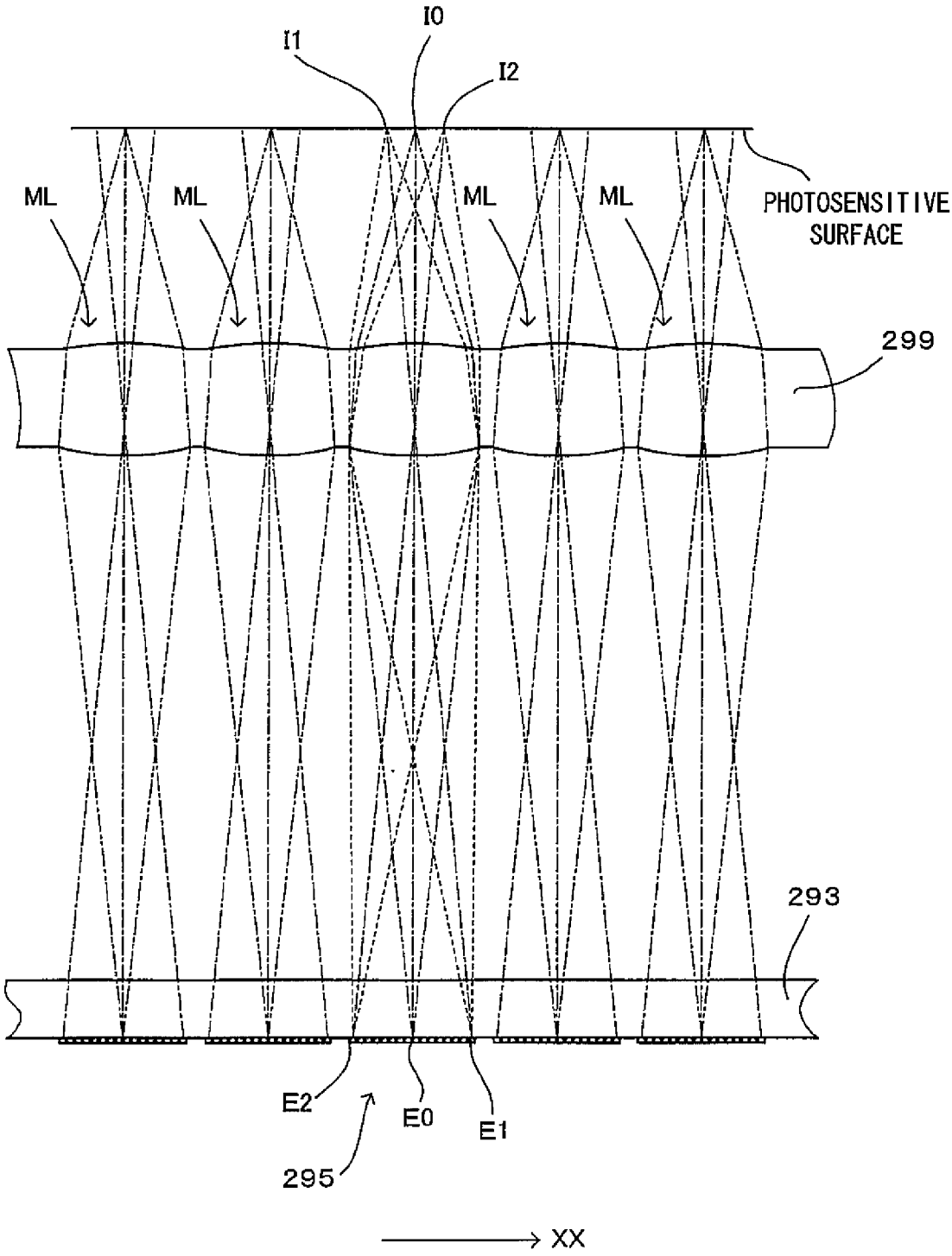
FIG. 8 is a diagram showing an imaging state of the microlens array according to this embodiment.

FIG. 8 is a diagram showing an imaging state of the microlens array according to this embodiment. Specifically, FIG. 8 is a sectional view when the luminous element groups 295, the glass substrate 293 and the microlens array 299 are cut by a plane which includes the optical axis OA of the lens 2993A (which is the same as that of the lens 2993B) and is parallel to the main scanning direction XX. In FIG. 8, trajectories of light beams emitted from virtual luminous elements located at a position of a geometric gravity center E0 of each luminous element group 295 and at opposite ends E1 and E2 of each luminous element group 295 in the main scanning direction are shown in order to show the imaging state of the microlens array 299. As shown by such trajectories, the light beams emitted from the virtual luminous elements emerge out from the top surface of the glass substrate 293 after being incident on the underside surface of the glass substrate 293. The light beams having emerged from the top surface of the glass substrate 293 reach the photosensitive surface (surface-to-be-scanned) via the microlens array 299. Here, the glass substrate 293 and the microlens array 299 respectively have specified relative refractive indices.

As shown in FIG. 8, the light beam emitted from the virtual luminous element located at the position of the geometric gravity center E0 of the luminous element group is imaged on an intersection I0 of the surface of the photosensitive drum 21 and the optical axis OA of the lenses 2993A and 2993B. This results from the fact that the position of the geometric gravity center E0 of the luminous element group 295 lies on the optical axis OA of the lenses 2993A and 2993B in this embodiment as described above. The light beams emitted from the virtual luminous elements located at the opposite ends E1 and E2 of the luminous element group 295 in the main scanning direction are imaged at positions I1 and I2 of the surface of the photosensitive drum 21 respectively. Specifically, the light beam emitted from the virtual luminous element located at the position E1 is imaged at the position I1 at an opposite side of the optical axis OA of the lenses 2993A and 2993B with respect to the main scanning direction XX, and the light beam emitted from the virtual luminous element located at the position E2 is imaged at the position I2 at an opposite side of the optical axis OA of the lenses 2993A and 2993B with respect to the main scanning direction XX. In other words, the optical system constructed by the glass substrate 293, the lens pair comprised of the lenses 2993A and 2993B having a common optical axis, and the glass substrate 2991 located between the lens pair, that is, the microlens ML is a so-called inverting optical system having an inverting property.

Further, as shown in FIG. 8, a distance between the positions I1 and I0 where the light beams are imaged is shorter than a distance between the positions E1 and E0 where the virtual luminous elements are located. That is to say that the absolute value of the magnification of the above optical system in this embodiment is below 1. In other words, the above optical system (microlens ML) in this embodiment is a so-called reducing optical system having a reducing property.

Figure 9:
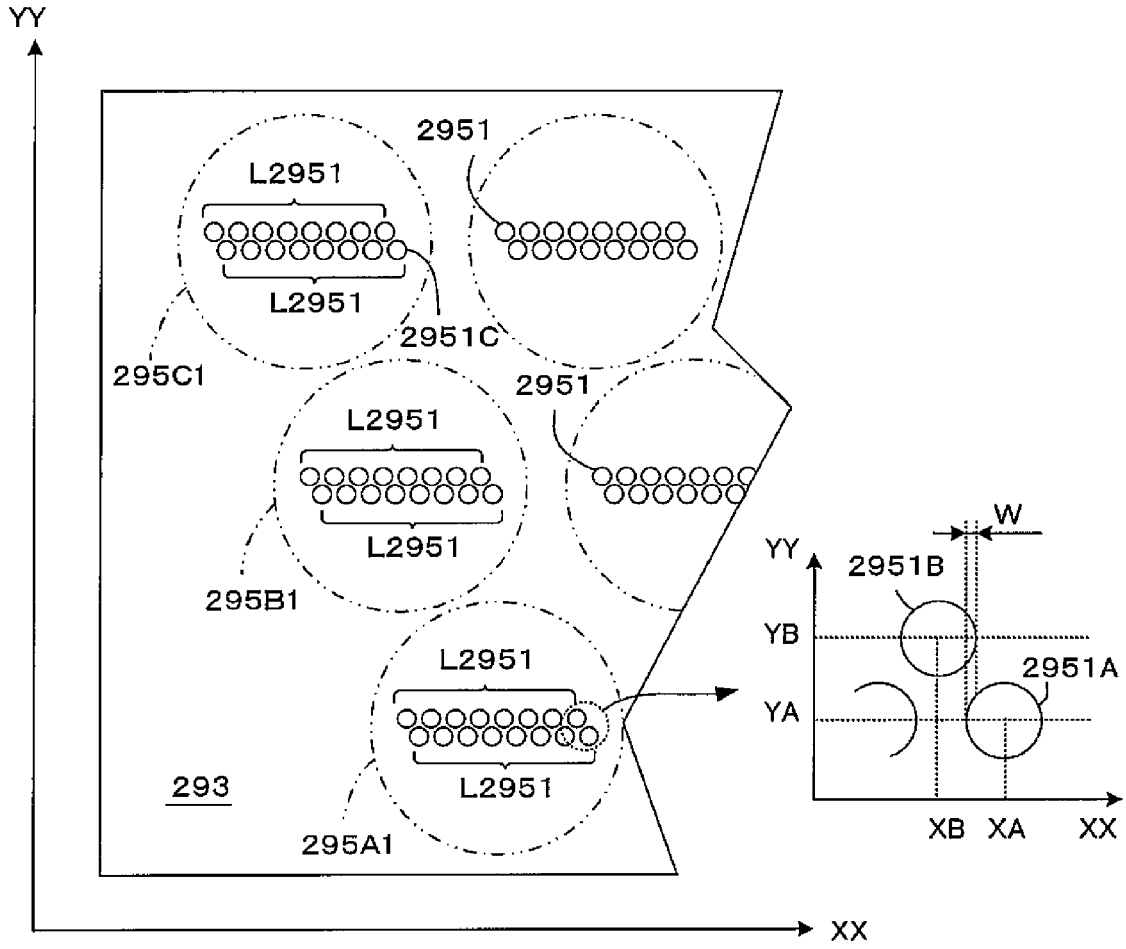
FIG. 9 is a diagram showing the arrangement of the luminous elements of this embodiment in detail.

FIG. 9 is a diagram showing the arrangement of the luminous elements of this embodiment in detail. As shown in FIG. 9, two luminous element lines L2951, each of which is formed by arranging eight luminous elements at specified intervals in the main scanning direction XX, are arranged in the sub scanning direction YY In the same luminous element group, the two luminous element lines L2951 are arranged in the sub scanning direction such that a plurality of luminous elements 2951 are located at different positions in the main scanning direction XX, and that two luminous elements 2951 at positions adjacent to each other in the main scanning direction XX belong to different luminous element lines L2951. Thus, in this embodiment, a plurality of luminous elements 2951 are arranged such that the sub-scanning-direction positions of two luminous elements 2951 having adjacent main-scanning-direction positions differ from each other in the same luminous element group. In other words, when attention is paid to two luminous elements 2951A and 2951B in FIG. 9 for example, the main-scanning-direction positions of these two luminous elements 2951A and 2951B are respectively positions XA and XB which are adjacent to each other. The sub-scanning-direction positions of the two luminous elements 2951A and 2951B having the adjacent main-scanning-direction positions are positions YA and YB which are different from each other.

Further, as shown in FIG. 9, in this embodiment, the plurality of luminous elements 2951 are arranged such that two luminous elements 2951 having adjacent main-scanning-direction positions partly overlap each other in the main scanning direction in the same luminous element group. In other words, when attention is paid to two luminous elements 2951A and 2951B in FIG. 9 for example, the main-scanning-direction positions of these two luminous elements 2951A and 2951B are adjacent to each other as described above. And, these adjacent two luminous elements 2951A and 2951B partly overlap each other in the main scanning direction XX by the width W Further, the luminous element groups which are adjacent to each other in the main scanning direction XX partly overlap each other in the main scanning direction XX. In each luminous element group, out of the plurality of luminous elements 2951 constituting the luminous element group, the closest luminous element which is closest to the other luminous element group adjacent to this luminous element group in the main scanning direction XX is arranged at a position different from the position of the other luminous element group in the sub scanning direction YY For example, when attention is paid to the luminous element group 295C1, the luminous element group 295B1 is adjacent to the luminous element group 295C1 in the main scanning direction XX while partly overlapping the luminous element group 295C1. The luminous element 2951C of the luminous element group 295C1 is closest to the luminous element group 295B1 and corresponds to the "closest luminous element" of the invention. This luminous element 2951C is arranged at a position different from the luminous element group 295B1 in the sub scanning direction YY Thus, as shown in FIGS. 7 and 8, intervals between the luminous elements 2951 can be widened not only in the same luminous element groups, but also between adjacent luminous element groups. A flexibility in arranging the luminous element groups and the luminous elements 2951 can be enhanced by adopting such an arrangement. Further, as described next, the wiring WL can be laid between the luminous elements, thereby enhancing a flexibility in wiring.

Next, a spot forming operation by means of the line head constructed as above is described. Here, a spot forming operation by the respective luminous element groups is first described in comparison to a comparative example with reference to FIGS. 10A to 10C, 11A and 11B. Thereafter, the spot forming operation by means of the line head is described in detail.

Figures 10A, 10B, 10C:
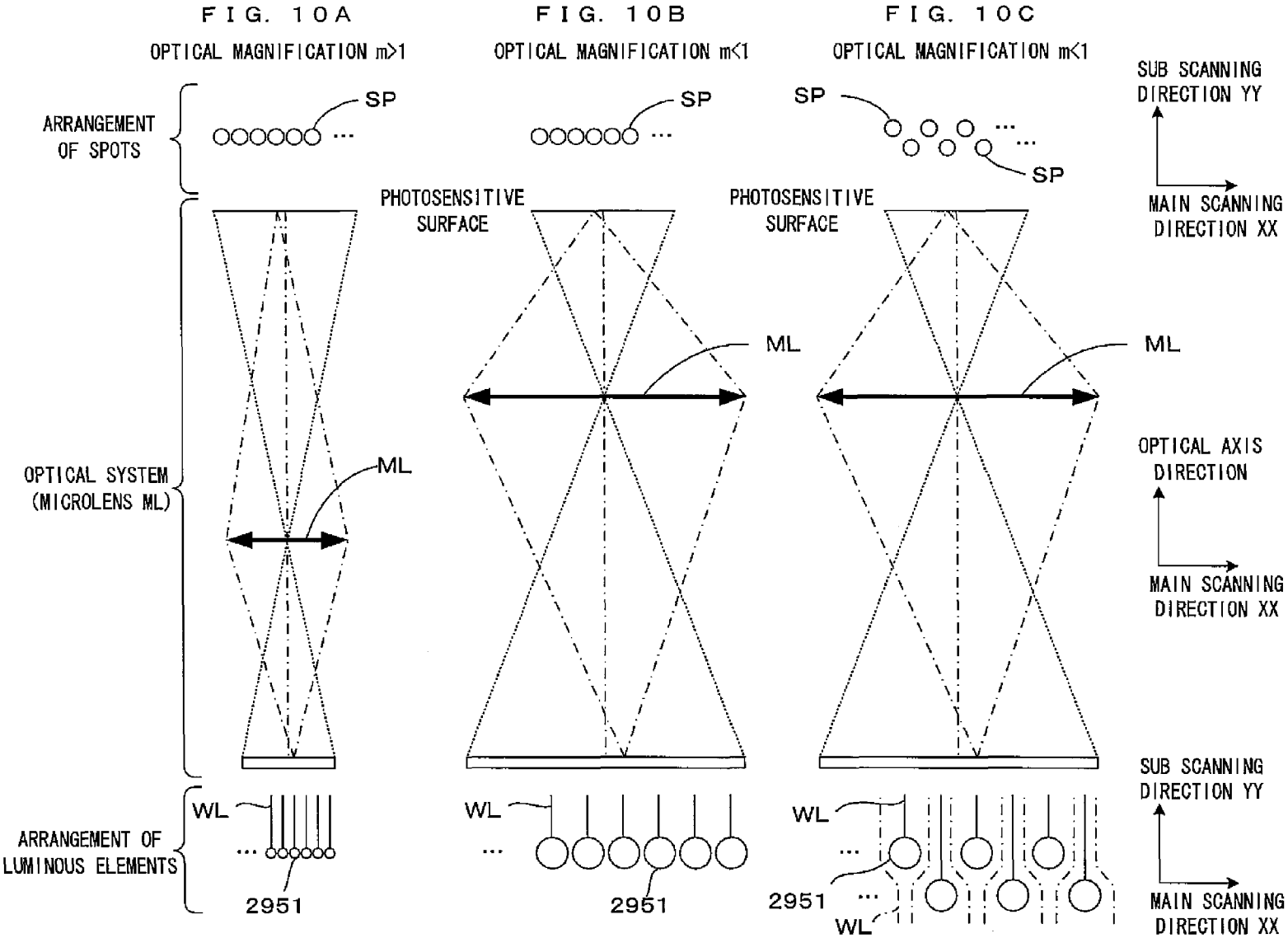
FIGS. 10A to 10C are diagrams schematically showing relationships between the configuration of the luminous element group and spot forming positions.
Figures 11A, 11B:
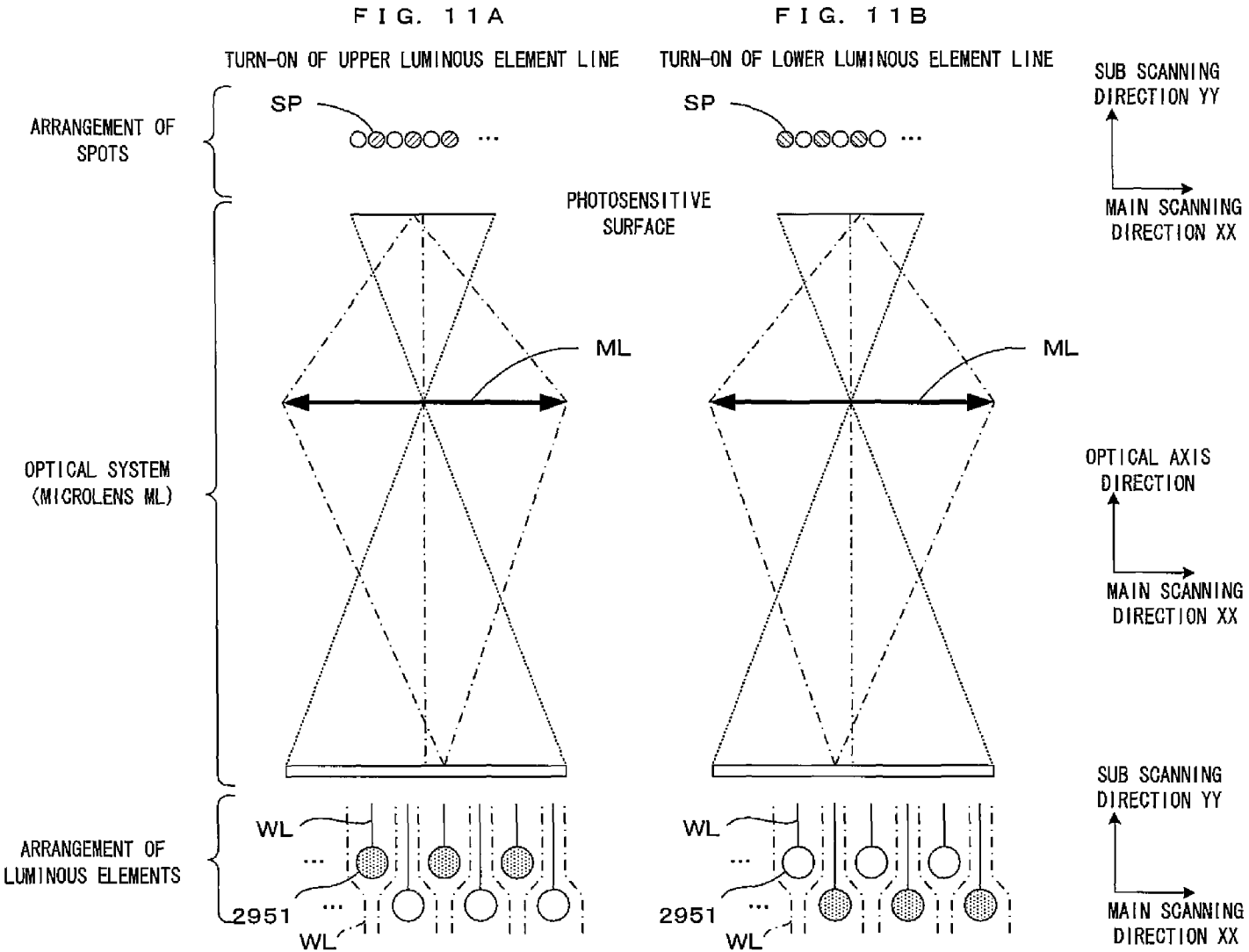
FIGS. 11A and 11B are diagrams schematically showing the spot forming operation by means of the luminous element group according to this embodiment.

FIGS. 10A to 10C are diagrams schematically showing relationships between the configuration of the luminous element group and spot forming positions, and FIGS. 11A and 11B are diagrams schematically showing the spot forming operation by means of the luminous element group according to this embodiment. FIG. 10A shows the arrangement of luminous elements and spot forming positions in the comparative example. In the comparative example, luminous elements 2951 are arranged in a row in the main scanning direction XX, and light beams from the respective luminous elements 2951 are imaged in a spot on the photosensitive surface by an enlarging optical system (m>1, where m is an optical magnification). Accordingly, the size of the luminous elements 2951 themselves needs to be made smaller in order to improve resolution by making spots SP smaller, but it has been difficult to ensure sufficient light quantities of the light beams.

On the other hand, it is thought to use an optical system having m (an optical magnification) below 1, that is, a reducing optical system (FIG. 10B). In this case, light beams emitted from larger luminous elements 2951 can be imaged in smaller spots SP, thereby making it possible to form smaller spots SP with the light beams having large light quantities. Further, in this embodiment, since the arrangement of the luminous elements 2951 is contrived as described above, it is possible to enhance the flexibility in arranging the luminous elements 2951 and the flexibility of the wiring WL (FIG. 10C). However, if the luminous elements 2951 arranged in a staggered arrangement as shown in FIG. 10C are simultaneously turned on, the spots SP formed on the photosensitive surface also come to have a two-dimensional arrangement.

Accordingly, in this embodiment, the luminous elements 2951 constituting the respective luminous element lines L2951 are caused to emit lights at timings corresponding to the rotational movement of the photosensitive drum 21 as shown in FIGS. 11A and 11B. In other words, the upper luminous element line is turned on (FIG. 11A) at a timing different from that of the lower luminous element line (FIG. 11B) in accordance with the rotational movement of the photosensitive drum 21. Thus, the spots SP formed by the upper luminous element line and those formed by the lower luminous element line can be formed side by side in the main scanning direction XX only by this timing adjustment. In this way, the spots SP can be formed in a row in the main scanning direction XX by a simple adjustment of the light emission timings.

Figure 12:
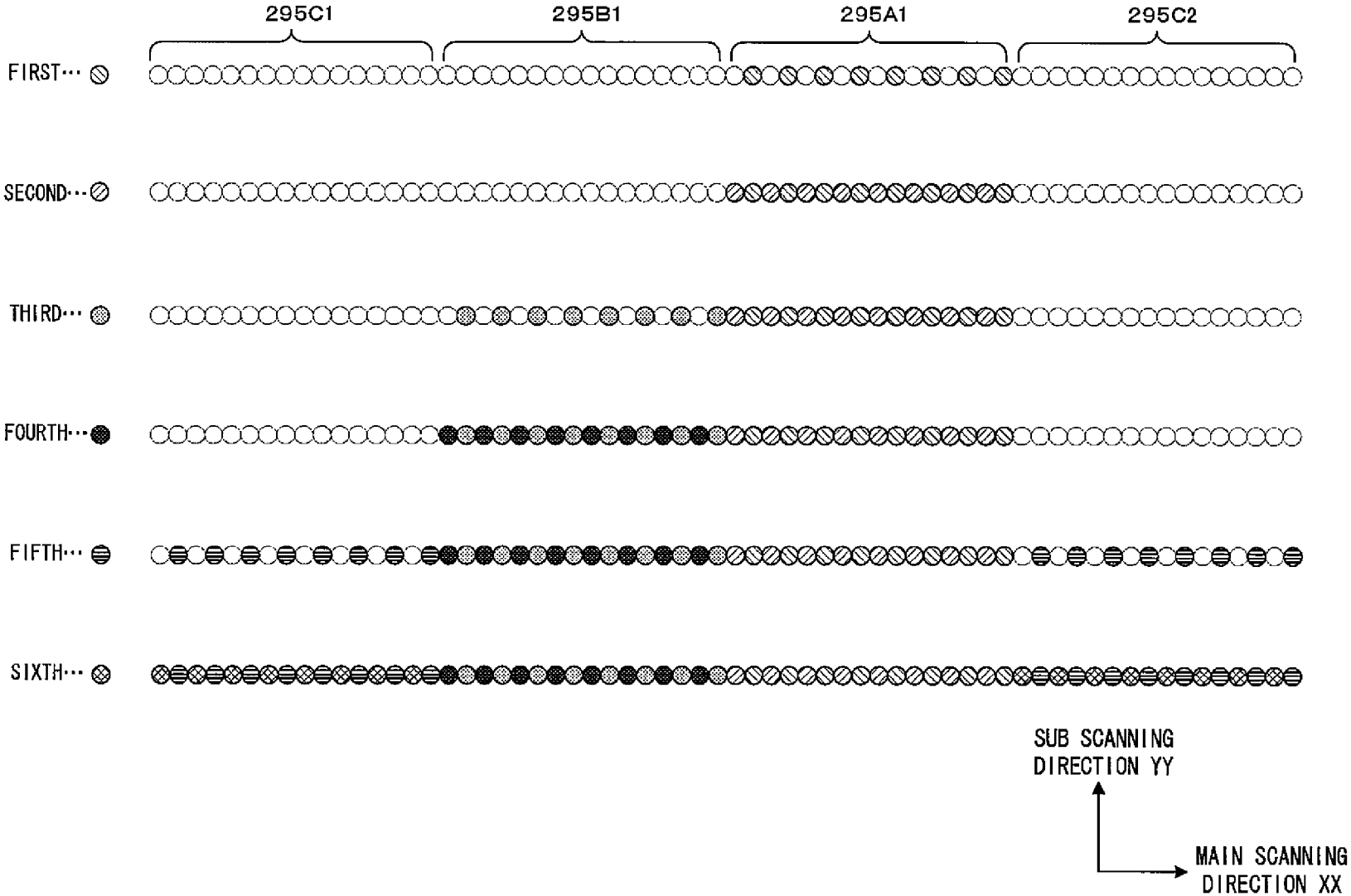
FIG. 12 is a diagram showing the spot forming operation by means of the above line head.

FIG. 12 is a diagram showing the spot forming operation by means of the above line head. The spot forming operation by means of the line head according to this embodiment is described below with reference to FIGS. 2, 7, 11A, 11B and 12. In order to make the invention easily understandable, here is described the case where a plurality of spots are formed side by side on a straight line extending in the main scanning direction XX. In this embodiment, a plurality of spots are formed side by side on a straight line extending in the main scanning direction XX by causing a plurality of luminous elements to emit lights at specified timings by the head control module 54 while the surface (surface-to-be-scanned) of the photosensitive drum (latent image carrier) 21 is transported in the sub scanning direction YY.

Specifically, in the line head of this embodiment, six luminous element lines L2951 are arranged in the sub scanning direction YY corresponding to sub-scanning-direction positions Y1 to Y6 (FIG. 7). Accordingly, in this embodiment, the luminous element lines L2951 at the same sub-scanning-direction position are caused to emit lights substantially at the same timing and the luminous element lines L2951 at different sub-scanning-direction positions are caused to emit lights at different timings from each other. More specifically, the luminous element lines L2951 are caused to emit lights in the order of the sub-scanning-direction positions Y1 to Y6. By causing the luminous element lines L2951 to emit lights in the above order while transporting the surface of the photosensitive drum 21 in the sub scanning direction YY, a plurality of spots are formed side by side on a straight line extending in the main scanning direction XX on the above surface.

Such an operation is described with reference to FIGS. 7 and 12. First of all, the luminous elements 2951 of the luminous element lines L2951 at the sub-scanning-direction position Y1 belonging to the luminous element groups 295A1, 295A2, 295A3, . . . which are located most upstream in the sub scanning direction YY are caused to emit lights. A plurality of light beams emitted by such a light emitting operation are imaged on the photosensitive surface while being inverted and reduced by the microlenses ML having the above inverting and reducing property. In other words, spots are formed at hatched positions of the "first" light emitting operation of FIG. 12. Meanwhile, in FIG. 12, outline circles represent spots not formed yet, but planned to be formed later. Further, in FIG. 12, spots labeled with reference characters 295C1, 295B1, 295A1 and 295C2 are those to be formed by the luminous element groups 295 corresponding to the respectively assigned reference characters.

Subsequently, the luminous elements 2951 of the luminous element lines L2951 at the sub-scanning-direction position Y2 belonging to the same luminous element groups 295A1, 295A2, 295A3, . . . are caused to emit lights. A plurality of light beams emitted by such a light emitting operation are imaged on the photosensitive surface while being inverted and reduced by the microlenses ML having the above inverting and reducing property. In other words, spots are formed at hatched positions of the "second" light emitting operation of FIG. 12. Here, the luminous element lines L2951 are caused to emit lights from the downstream side with respect to the sub scanning direction YY (that is, in the order of the sub-scanning-direction positions Y1 and Y2), while the surface of the photosensitive drum 21 is transported in the sub scanning direction YY. The reason is to cope with the fact that the microlenses ML have the inverting property.

Next, the luminous elements 2951 of the luminous element lines L2951 at the sub-scanning-direction position Y3 belonging to the luminous element groups 295B1, 295B2, 295B3, . . . are caused to emit lights. A plurality of light beams emitted by such a light emitting operation are imaged on the photosensitive surface while being inverted and reduced by the microlenses ML having the above inverting and reducing property. In other words, spots are formed at hatched positions of the "third" light emitting operation of FIG. 12.

Subsequently, the luminous elements 2951 of the luminous element lines L2951 at the sub-scanning-direction position Y4 belonging to the same luminous element groups 295B1, 295B2, 295B3, . . . are caused to emit lights. A plurality of light beams emitted by such a light emitting operation are imaged on the photosensitive surface while being inverted and reduced by the microlenses ML having the above inverting and reducing property. In other words, spots are formed at hatched positions of the "fourth" light emitting operation of FIG. 12.

Subsequently, the luminous elements 2951 of the luminous element lines L2951 at the sub-scanning-direction position Y5 belonging to the luminous element groups 295C1, 295C2, 295C3, . . . are caused to emit lights. A plurality of light beams emitted by such a light emitting operation are imaged on the photosensitive surface while being inverted and reduced by the microlenses ML having the above inverting and reducing property. In other words, spots are formed at hatched positions of the "fifth" light emitting operation of FIG. 12.

Finally, the luminous elements 2951 of the luminous element lines L2951 at the sub-scanning-direction position Y6 belonging to the same luminous element groups 295C1, 295C2, 295C3, . . . are caused to emit lights. A plurality of light beams emitted by such a light emitting operation are imaged on the photosensitive surface while being inverted and reduced by the microlenses ML having the above inverting and reducing property. In other words, spots are formed at hatched positions of the "sixth" light emitting operation of FIG. 12. In this way, a plurality of spots are formed side by side on the straight line extending in the main scanning direction XX by performing the first to sixth light emitting operations.

As described above, according to this embodiment, in the luminous element groups, a plurality of luminous elements 2951 are arranged at mutually different positions in the main scanning direction XX, and two luminous elements which emit lights to form adjacent spots are arranged at mutually different positions in the sub scanning direction YY. And, by causing the luminous elements 2951 to emit lights at timings corresponding to the movement of the photosensitive drum 21 in the sub scanning direction YY, the light beams emitted from the luminous elements are imaged on the photosensitive surface at mutually different positions in the main scanning direction XX to form the spots SP side by side in the main scanning direction XX.

Further, the light beams emitted from the luminous elements 2951 are imaged on the photosensitive surface (surface-to-be-scanned) by means of the microlenses ML having a magnification whose absolute value is below 1 (that is, reducing optical systems). Thus, it becomes possible to image the light beams emitted from the large luminous elements 2951 into small spots. In other words, it becomes possible to form small spots using light beams having large light quantities. Thus, high resolution can be realized while sufficient light quantities of the light beams involved in the spot formation are ensured, and it is possible to realize good formation of spots even in high resolution. The reason is as follows.

In order to improve the resolution in an apparatus using the enlarging optical system as shown in FIG. 10A for example, the diameter of the luminous elements 2951 needs to be made smaller. However, it is difficult in production to make the diameter of the element smaller while ensuring emission of light with a desired light quantity. Further, the driving of the luminous elements 2951 becomes unstable and spots cannot be satisfactorily formed on the photosensitive surface. Particularly, this has been a main cause of image quality deterioration in image forming apparatuses.

On the other hand, the diameter of the luminous elements 2951 can be set larger since the microlenses ML, which are reducing optical systems, are used in the apparatus according to this embodiment. In addition, since the luminous elements 2951 are arranged as described above in the luminous element groups, intervals between the luminous elements 2951 can be widened even if intervals between spots to be formed on the photosensitive surface are small. Thus, the luminous elements 2951 having a diameter sufficiently large to provide emission of light with desired light quantities can be formed in a relatively large space because (a) the reducing optical systems are used and (b) the arrangement of the luminous elements 2951 in the luminous element groups is contrived. Accordingly, the elements can be easily formed. Further, the driving of the luminous elements 2951 can be stabilized, which enables good spots to be formed on the photosensitive surface. As a result, a toner image of an excellent quality can be formed.

Incidentally, in line heads of this type, spots are formed at specified positions of the photosensitive surface (surface-to-be-scanned) by adjusting the light emission timings of the respective luminous elements 2951. Compared with this, in the line head of this embodiment, the luminous element lines L2951, each of which is formed by arranging only a specified number (eight) of luminous elements 2951 at specified intervals in the main scanning direction XX, are used. Specifically, the sub-scanning-direction positions of all the luminous elements 2951 belonging to one luminous element line L2951 are substantially the same. Thus, in the case where spots by light beams emitted from the respective luminous elements 2951 are formed side by side in the main scanning direction XX, using the line head of this embodiment, substantially the same light emission timing can be applied to the luminous elements 2951 belonging to one luminous element line L2951, which is preferable because the adjustments of the light emission timings can be simplified.

Further, the image forming apparatus of this embodiment using the line head described above forms spots on the photosensitive surface (latent image carrier surface) using the above line head. In other words, a latent image can be formed by imaging light beams having sufficient light quantities as spots on the photosensitive surface. Therefore, good images in high resolution can be realized, which is preferable.

It should be noted that the invention is not limited to the embodiment above, but may be modified in various manners in addition to the embodiment above, to the extent not deviating from the object of the invention. For example, in the above embodiment, a plurality of spots are formed side by side along the straight line in the main scanning direction XX as shown in FIG. 12 by means of the line head having the two luminous element lines L2951. However, such a spot forming operation is an example of the operation of the line head according to the invention, and an operation executable by this line head is not limited to this. Specifically, it is not necessary to form spots side by side along a straight line in the main scanning direction XX. For example, spots may be formed side by side along a line at a specified angle to the main scanning direction XX or along a zigzag line or a wavy line. In other words, it is sufficient to arrange two luminous elements 2951, which are caused to emit lights to form adjacent spots SP, at mutually different positions in the sub scanning direction YY. In this case, the luminous elements may be caused to emit lights at timings in conformity with the movement of the surface-to-be-scanned in the sub scanning direction, and light beams emitted from the luminous elements may be imaged on the surface-to-be-scanned at mutually different positions in the main scanning direction to form a plurality of spots side by side in the main scanning direction.

Further, in the above embodiment, two luminous element lines L2951, each of which is formed by arranging eight luminous elements 2951 at specified intervals in the main scanning direction XX, are arranged in the sub scanning direction YY However, the state of the construction and arrangement of the luminous element lines L2951 (in other words, the state of the arrangement of a plurality of luminous elements) is not limited to this. Specifically, three luminous element lines L2951, each of which is formed by arranging five luminous elements 2951 at specified intervals in the main scanning direction XX, may be arranged in the sub scanning direction YY. Or four luminous element lines L2951, each of which is formed by arranging six luminous elements 2951 at specified intervals in the main scanning direction XX, may be arranged in the sub scanning direction YY In short, it is sufficient to arrange the plurality of luminous elements 2951 such that the positions thereof in the main scanning direction XX differ from each other and two luminous elements 2951 caused to emit lights to form adjacent spots SP are at mutually different positions in the sub scanning direction YY Although the organic EL (electroluminescence) devices are used as the luminous elements 2951 in the above embodiment, the specific construction of the luminous elements 2951 is not limited to this and LEDs (light emitting diodes) may be, for example, used as the luminous elements 2951.

Figure 13:
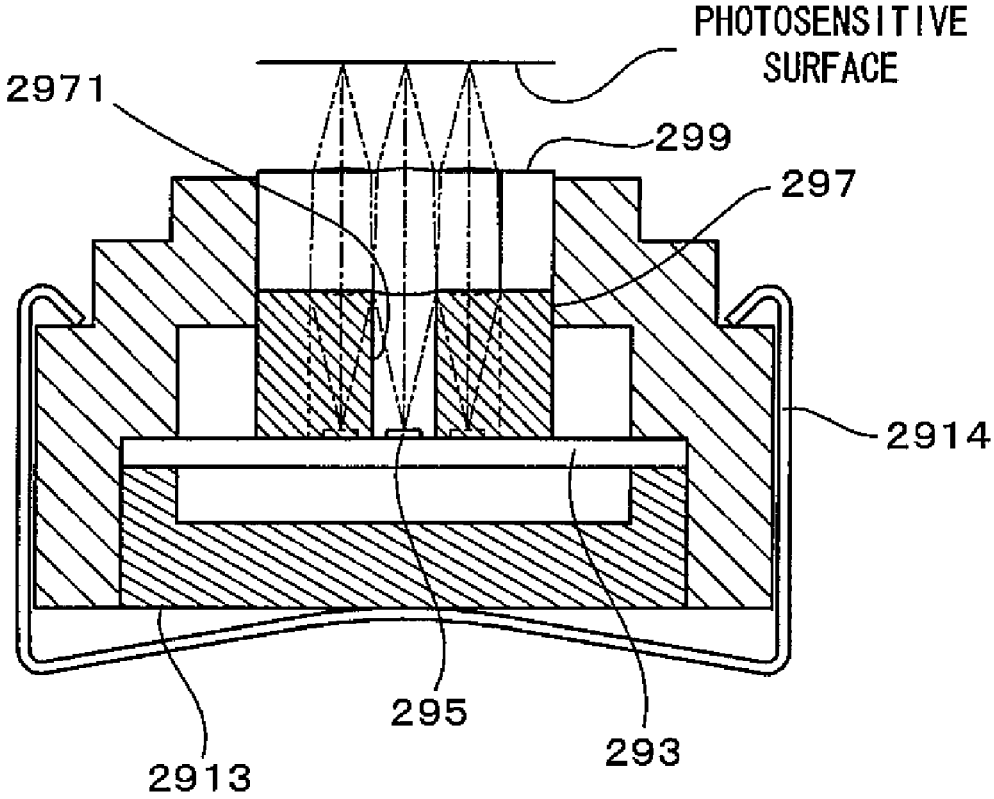
FIG. 13 is a sectional view in the sub scanning direction of another embodiment of a line head according to the invention.

FIG. 13 is a sectional view in the sub scanning direction of another embodiment of a line head (exposure section) according to the invention. Specifically, LEDs are used as luminous elements in the line head of FIG. 13. A main difference from the line head using the organic EL devices as luminous elements shown in FIG. 4 is the position the luminous elements are arranged. In other words, the luminous elements (luminous element groups 295) are arranged on the underside surface of the glass substrate 293 in the line head using the organic EL devices as the luminous elements as shown in FIG. 4. On the other hand, the luminous elements are arranged on the top surface of the substrate 293 in the line head using the LEDs as the luminous elements shown in FIG. 13. Since the other construction is common to both line heads shown in FIGS. 4 and 13, it is not described by being identified by suitable reference characters. Meanwhile, for the arrangement of the luminous elements 2951 on the surface of the substrate 293, an arrangement as in the case of the organic EL devices may also be applied in the case of the LEDs.

Figure 14:
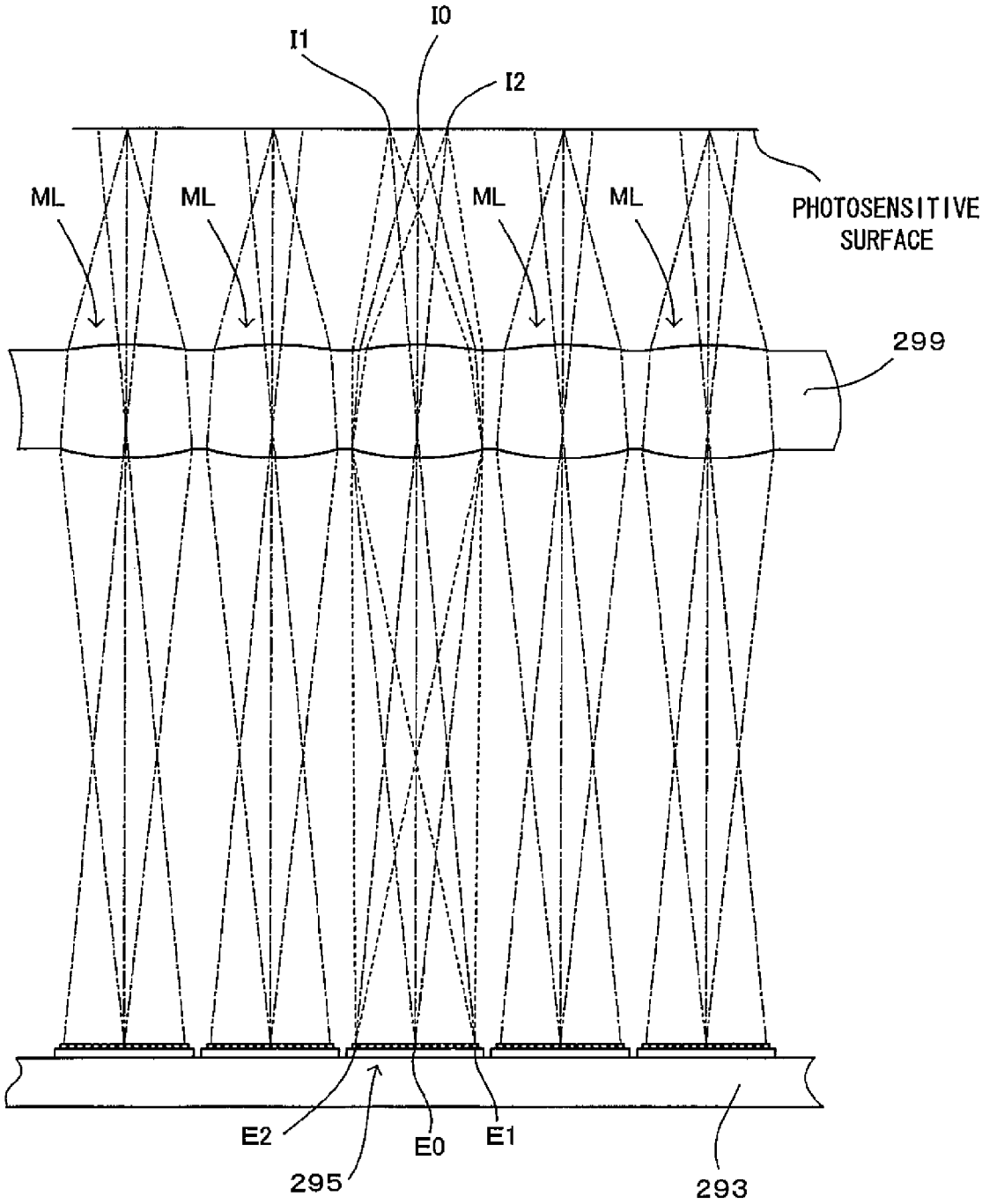
FIG. 14 is a diagram showing an imaging state of a microlens array according to another embodiment.

FIG. 14 is a diagram showing an imaging state of a microlens array according to another embodiment. That is, FIG. 14 is a sectional view showing an imaging state of the line head using the LEDs as the luminous elements. Specifically, FIG. 14 is a sectional view of the luminous element groups 295, the glass substrate 293 and the microlens array 299, the cutting plane being a plane which includes the optical axis OA of the lens 2993A (which is the same as that of the lens 2993B) and is parallel to the main scanning direction XX. Further, in FIG. 14, the trajectories of light beams emitted from virtual luminous elements located at position of a geometric gravity center E0 of each luminous element group 295 and at opposite ends E1 and E2 of each luminous element group 295 in the main scanning direction are shown in order to show the imaging state of the microlens array 299. As described above, the luminous elements (luminous element groups 295) are formed on the top surface of the substrate 293 in the line head using the LEDs as the luminous elements. Thus, light beams emitted from the luminous elements (LEDs) come to be incident on the microlens array 299 without passing through the glass substrate. In other words, the lights emitted from the luminous elements are directly incident on the microlens array 299 and imaged on a photosensitive surface (surface-to-be-scanned) by the microlens array 299 in the line head using the LEDs as the luminous elements. In this way, the light beams emitted from the luminous elements do not pass through the substrate 293, on which the luminous elements are arranged, in the line head using the LEDs. Therefore, the material of the substrate 293 is not limited to a transparent material such as glass.

As shown in FIG. 14, the light beam emitted from the virtual luminous element located at the position of the geometric gravity center E0 of the luminous element group is imaged on an intersection I0 of the surface of the photosensitive drum 21 and the optical axis OA of the lenses 2993A and 2993B. This results from the fact that the position of the geometric gravity center E0 of the luminous element group 295 lies on the optical axis OA of the lenses 2993A and 2993B. The light beams emitted from the virtual luminous elements located at the opposite ends E1 and E2 of the luminous element group 295 in the main scanning direction are imaged at positions I1 and I2 of the surface of the photosensitive drum 21. Specifically, the light beam emitted from the virtual luminous element located at the position E1 is imaged at the position I1 at an opposite side of the optical axis OA of the lenses 2993A and 2993B with respect to the main scanning direction XX, and the light beam emitted from the virtual luminous element located at the position E2 is imaged at the position 12 at an opposite side of the optical axis OA of the lenses 2993A and 2993B with respect to the main scanning direction XX. In other words, an optical system (microlens ML) constructed by the lens pair comprised of the lenses 2993A and 2993B having the common optical axis, and a glass substrate 2991 located between the lens pair is a so-called inverting optical system.

Further, as shown in FIG. 14, a distance between the positions I1 and I0 where the light beams are imaged is shorter than a distance between the positions E1 and E0 where the virtual luminous elements are located. That is to say that the absolute value of the magnification of the above optical system in this embodiment is below 1. In other words, the optical system in this another embodiment is a reducing optical system.

Although the invention is applied to the color image forming apparatus in the above embodiment, the application thereof is not limited to this and the invention is also applicable to monochromatic image forming apparatuses which form monochromatic images.

Next, examples of the invention are described, but the invention is not limited by the following examples. The invention can be, of course, implemented by being suitably changed within a range conformable to the object described above and below and such embodiments are all embraced by the technical scope of the invention. It should be noted that a specific example of a microlens ML applicable to the invention, that is, a microlens ML having a magnification whose absolute value is below 1 is described in the following examples.

FIRST EXAMPLE

Figure 15:
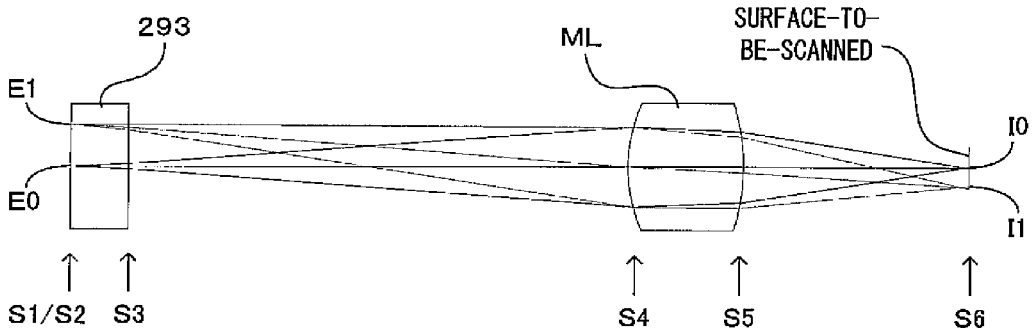
FIG. 15 is a diagram showing an imaging state of the microlens according to the first example.

Table 1 shows lens data of a line head according to a first example. FIG. 15 is a diagram showing an imaging state of the microlens according to the first example. The line head according to the first example uses organic EL devices as luminous elements. As also described in the above embodiment, such organic EL devices are arranged on the underside surface of the glass substrate 293. Thus, a light emitting surface (surface number S1) of the luminous elements and the underside surface (surface number S2) of the glass substrate 293 are opposed to each other while defining a surface interval of 0.

TABLE 1

| SURFACE NUMBER | SURFACE TYPE | y RADIUS OF CURVATURE | SURFACE INTERVAL | REFRACTIVE INDEX |
|---|---|---|---|---|
| S1 (OBJECT PLANE) | | ∞ | 0 | |
| S2 | PLANE | ∞ | 0.5 | nd = 1.51680, vd = 64.2 |
| S3 | PLANE | ∞ | 4.326 | |
| S4 | SPHERICAL SURFACE | 1.6 | 1 | nd = 1.62005, vd = 36.4 |
| S5 | SPHERICAL SURFACE | −2.130151613 | 2 | |
| S6 (IMAGE PLANE) | | | 0 | |

A light beam emitted from a position E0 on an object plane is imaged at a position I0 on a surface-to-be-scanned (image plane) via the glass substrate 293 and the microlens ML. Further, a light beam emitted from a position E1 on the object plane is imaged at a position I1 on the surface-to-be-scanned (image plane) via the glass substrate 293 and the microlens ML. Here, both the position E0 and the position I0 are located on an optical axis of the microlens ML. As shown in FIG. 15, a distance between the positions I0 and I1 on the image plane is shorter than a distance between the positions E0 and E1 on the object plane. In other words, the absolute value of the magnification of the optical system including the glass substrate 293 and the microlens ML is below 1, specifically is 0.5.

SECOND EXAMPLE

Figure 16:
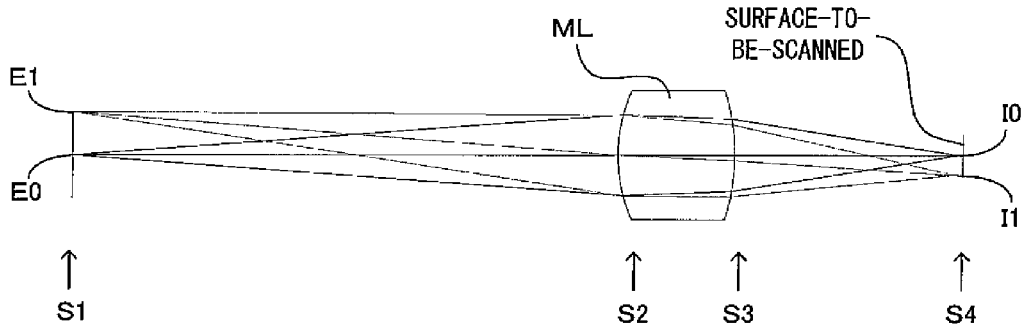
FIG. 16 is a diagram showing an imaging state of the microlens according to the second example.

Table 2 shows lens data of a line head according to a second example. FIG. 16 is a diagram showing an imaging state of a microlens according to the second example. The line head according to the second example uses LEDs as luminous elements. As also described in the above embodiment, such LEDs are arranged on the top surface of a substrate 293. Thus, light beams emitted from the luminous elements are incident on the microlens ML without passing through the substrate 293.

TABLE 2

| SURFACE NUMBER | SURFACE TYPE | y RADIUS OF CURVATURE | SURFACE INTERVAL | REFRACTIVE INDEX |
|---|---|---|---|---|
| S1 (OBJECT PLANE) | | ∞ | 2.960158716 | |
| S2 | SPHERICAL SURFACE | 1.4754 | 1 | nd = 1.62005, vd = 36.4 |
| S3 | SPHERICAL SURFACE | −1.5506 | 2 | |
| S4 (IMAGE PLANE) | | | 0 | |

A light beam emitted from a position E0 on an object plane is imaged at a position I0 on a surface-to-be-scanned (image plane) via the microlens ML. Further, a light beam emitted from a position E1 on the object plane is imaged at a position I1 on the surface-to-be-scanned (image plane) via the microlens ML. Here, both the position E0 and the position I0 are located on an optical axis of the microlens ML. As shown in FIG. 16, a distance between the positions I0 and I1 on the image plane is shorter than a distance between the positions E0 and E1 on the object plane. In other words, the absolute value of the magnification of the optical system including the microlens ML is below 1, specifically is 0.5.

Although the invention has been described with reference to specific embodiments, this description is not meant to be construed in a limiting sense. Various modifications of the disclosed embodiment, as well as other embodiments of the invention, will become apparent to persons skilled in the art upon reference to the description of the invention. It is therefore contemplated that the appended claims will cover any such modifications or embodiments as fall within the true scope of the invention.

What is claimed is:

1. A line head comprising:

a microlens array in which a plurality of microlenses having a magnification whose absolute value is below 1 are arranged in a main scanning direction of a surface-to-be-scanned, and a plurality of luminous element groups which are arranged in a one-to-one correspondence with the respective plurality of microlenses, wherein in each of the plurality of luminous element groups, a plurality of luminous elements are arranged at mutually different main-scanning-direction positions in the main scanning direction, the plurality of luminous elements are respectively, caused to emit lights at timings in conformity with a movement of the surface-to-be-scanned in a sub scanning direction, and light beams emitted from the plurality of luminous elements are imaged on the surface-to-be-scanned at mutually different main-scanning-direction positions in the main scanning direction to form a plurality of spots side by side on the surface-to-be-scanned in the main scanning direction, each of the spots having a diameter smaller than that of the respective luminous elements, in each of the plurality of luminous element groups, out of the plurality of luminous elements constituting the luminous element group, two luminous elements caused to emit lights to form adjacent spots are arranged at mutually different sub-scanning-direction positions in the sub scanning direction, out of the plurality of microlenses, two microlenses adjacent to each other in the main scanning direction are arranged at mutually different sub-scanning-direction positions in the sub scanning direction, each of the two microlenses being an inverting optical system, a first and a second luminous element groups are arranged corresponding to the two microlenses respectively, the first luminous element group being located upstream of the second luminous element group in the sub scanning direction and emitting lights earlier than the second luminous element group, and in each of the first and the second luminous element groups, a first and a second luminous elements are arranged at mutually different sub-scanning-direction positions, the second luminous element being located downstream of the first luminous element in the sub scanning direction and emitting light earlier than the first luminous element.

2. A line head comprising:

a microlens array in which a plurality of microlenses having a magnification whose absolute value is below 1 are arranged in a main scanning direction of a surface-to-be-scanned, a plurality of luminous element groups which are arranged in a one-to-one correspondence with the respective plurality of microlenses, wherein each of the plurality of luminous element groups includes a plurality of luminous elements which are arranged in a staggered arrangement, the arranged positions of the luminous elements constituting each luminous element group in the main scanning direction differ from each other the plurality of luminous elements are respectively caused to emit lights at timings in conformity with a movement of the surface-to-be-scanned in a sub scanning direction, and light beams emitted from the plurality of luminous elements are imaged on the surface-to-be-scanned at mutually different main-scanning-direction positions in the main scanning direction to form a plurality of spots side by side on the surface-to-be-scanned in the main scanning direction, each of the spots having a diameter smaller than that of the respective luminous elements, out of the plurality of microlenses, two microlenses adjacent to each other in the main scanning direction are arranged at mutually different sub-scanning-direction positions in the sub scanning direction, each of the two microlenses being an inverting optical system, a first and a second luminous element groups are arranged corresponding to the two microlenses respectively, the first luminous element group being located upstream of the second luminous element group in the sub scanning direction and emitting lights earlier than the second luminous element group, and in each of the first and the second luminous element groups, a first and a second luminous elements are arranged at mutually different sub-scanning-direction positions, the second luminous element being located downstream of the first luminous element in the sub scanning direction and emitting light earlier than the first luminous element.

3. An image forming apparatus comprising:

a latent image carrier whose surface is transported in a sub scanning direction, a line head which images a plurality of spots on the surface of the latent image carrier in a main scanning direction substantially orthogonal to the sub scanning direction to form a latent image, and a developing section which develops the latent image on the latent image carrier with toner, wherein the line head includes:

a microlens array in which a plurality of microlenses having a magnification whose absolute value is below 1 are arranged in the main scanning direction, and a plurality of luminous element groups which are arranged in a one-to-one correspondence with the respective plurality of microlenses, and wherein in each of the plurality of luminous element groups, a plurality of luminous elements are arranged at mutually different main-scanning-direction positions in the main scanning direction, the plurality of luminous elements are respectively caused to emit lights at timings in conformity with a transportation of the surface of the latent image carrier in the sub scanning direction, and light beams emitted from the plurality of luminous elements are imaged on the surface of the latent image carrier at mutually different main-scanning-direction positions in the main scanning direction to form a plurality of spots side by side on the surface of the latent image carrier in the main scanning direction, each of the spots having a diameter smaller than that of the respective luminous elements, in each of the plurality of luminous element groups, out of the plurality of luminous elements constituting the luminous element group, two luminous elements caused to emit lights to form adjacent spots are arranged at mutually different sub-scanning-direction positions in the sub scanning direction, out of the plurality of microlenses, two microlenses adjacent to each other in the main scanning direction are arranged at mutually different sub-scanning-direction positions in the sub scanning direction, each of the two microlenses being an inverting optical system, a first and a second luminous element groups are arranged corresponding to the two microlenses respectively, the first luminous element group being located upstream of the second luminous element group in the sub scanning direction and emitting lights earlier than the second luminous element group, and in each of the first and the second luminous element groups, a first and a second luminous elements are arranged at mutually different sub-scanning-direction positions, the second luminous element being located downstream of the first luminous element in the sub scanning direction and emitting light earlier than the first luminous element.

4. An image forming apparatus comprising:

a latent image carrier whose surface is transported in a sub scanning direction, a line head which images a plurality of spots on the surface of the latent image carrier in a main scanning direction substantially orthogonal to the sub scanning direction to form a latent image, and a developing section which develops the latent image on the latent image carrier with toner, wherein the line head includes:

a microlens array in which a plurality of microlenses having a magnification whose absolute value is below 1 are arranged in the main scanning direction, and a plurality of luminous element groups which are arranged in a one-to-one correspondence with the respective plurality of microlenses, and wherein each of the plurality of luminous element groups has a plurality of luminous elements arranged in a staggered arrangement, the arranged positions of the luminous elements constituting each luminous element group in the main scanning direction differ from each other, the plurality of luminous elements are respectively caused to emit lights at timings in conformity with a transportation of the surface of the latent image carrier in the sub scanning direction, and light beams emitted from the plurality of luminous elements are imaged on the surface of the latent image carrier at mutually different main-scanning-direction positions in the main scanning direction to form a plurality of spots side by side on the surface of the latent image carrier in the main scanning direction, each of the spots having a diameter smaller than that of the respective luminous elements, out of the plurality of microlenses, two microlenses adjacent to each other in the main scanning direction are arranged at mutually different sub-scanning-direction positions in the sub scanning direction, each of the two microlenses being an inverting optical system, a first and a second luminous element groups are arranged corresponding to the two microlenses respectively, the first luminous element group being located upstream of the second luminous element group in the sub scanning direction and emitting lights earlier than the second luminous element group, and in each of the first and the second luminous element groups, a first and a second luminous elements are arranged at mutually different sub-scanning-direction positions, the second luminous element being located downstream of the first luminous element in the sub scanning direction and emitting light earlier than the first luminous element.

* * * * *